US006863598B2

(12) United States Patent
Ling et al.

(10) Patent No.: US 6,863,598 B2
(45) Date of Patent: Mar. 8, 2005

(54) EQUIPMENT FOR GRINDING OPTICAL FIBER END

(75) Inventors: Kow-Je Ling, Taipei (TW); Jiunn-Shiuh Juang, Chiai (TW)

(73) Assignee: Hermosa Thin Film Co., Ltd., Taipei (TW)

( * ) Notice: Subject to any disclaimer, the term of this patent is extended or adjusted under 35 U.S.C. 154(b) by 0 days.

(21) Appl. No.: 10/207,229

(22) Filed: Jul. 30, 2002

(65) Prior Publication Data

US 2003/0054741 A1 Mar. 20, 2003

(30) Foreign Application Priority Data

Aug. 13, 2001 (TW) ..... 90213798 U

(51) Int. Cl.[7] ..... B24B 7/00
(52) U.S. Cl. ..... 451/177; 451/163; 451/168
(58) Field of Search ..... 451/162–164, 451/167, 168, 170, 177, 296, 304, 305

(56) References Cited

U.S. PATENT DOCUMENTS 4,693,035 A * 9/1987 Doyle ..... 451/278
4,905,415 A * 3/1990 Moulin ..... 451/276
5,038,524 A * 8/1991 Moulin ..... 451/548
5,184,433 A * 2/1993 Maack ..... 451/41
5,349,784 A * 9/1994 Grois et al. ..... 451/314
5,403,227 A * 4/1995 Franklin et al. ..... 451/168
5,447,464 A * 9/1995 Franklin et al. ..... 451/28
5,674,114 A * 10/1997 Miller et al. ..... 451/278
5,823,859 A * 10/1998 Erdogan et al. ..... 451/65
6,302,763 B1 * 10/2001 Buzzetti ..... 451/11
6,396,996 B1 * 5/2002 Carpenter et al. ..... 385/137
6,428,391 B2 * 8/2002 Buzzetti ..... 451/11
6,454,631 B1 * 9/2002 Buzzetti ..... 451/11

* cited by examiner

*Primary Examiner*—David B. Thomas
(74) *Attorney, Agent, or Firm*—Bacon & Thomas, PLLC

(57) ABSTRACT

A device for grinding and polishing optical fiber ends. The device includes a holder and an elastic grinding surface. The holder is used to hold equidistantly a set of optical fibers such that the ends of the optical fibers are in contact with the elastic grinding surface capable of only eccentric rotation, to enable the grinding speed and the grinding direction of each of the optical fiber ends to be the same. The grinding direction is uniformly changed along with the change in time and the grinding angles in all direction are substantially the same.

33 Claims, 28 Drawing Sheets

EQUIPMENT FOR GRINDING OPTICAL FIBER END

FIELD OF THE INVENTION

The present invention relates generally to an equipment for grinding the ends of optical fibers, and more particularly to a grinding motion mode enabling instantly the grinding speed and grinding direction of the end of each optical fiber to be equal.

BACKGROUND OF THE INVENTION

As far as the current or future communication technology is concerned, the optical fiber communication is an indispensable tool. Like the cable communication system in which the signal cable and the signal connector are joined together, the optical fiber communication involves the use of the optical fiber connector. In the process of forming the optical fiber connector, an optical fiber is put through the hole of a ring such that the optical fiber is attached to the ring by an adhesive. The ring is made of a plastic, glass, or ceramic material. The end of the optical fiber attached to the ring is pressured on an elastic grinding surface and is then treated with a preliminary grinding process, a precision grinding process, and a polishing process, thereby resulting in the formation of a convex spherical face. The convex spherical face must be devoid of any defect. The optic axis of the convex spherical face may be parallel to the center line of the optical fiber or may form a small angle along with the center line of the optical fiber. The current grinding technology of the optical fiber end is basically evolved from the grinding technology of the optical lens. The manual grinding technology was followed by the machine grinding technology as illustrated in FIG. 1. Such a conventional method for grinding an optical lens involves the use of a grinding tray 10, which is provided with a grinding surface of cast iron in the course of the preliminary grinding and the precision grinding. The grinding tray 10 is provided with a grinding surface of asphalt or other polishing materials in the course of the polishing. In the grinding and the polishing processes, the grinding powders and the polishing powders of various grain densities are used along with water. The conventional method also involves the use of a workpiece holder to which a grinding workpiece assembly 2 is attached. The assembly 2 may be moved leftward and rightward in a reciprocating manner. The assembly 2 may be stationary. In case of an appropriate movement, the grinding surface in its entirety may be able to maintain a constant curvature due to the uniform wear. If the grinding surface is turned counterclockwise at ω angular speed, the workpiece assembly is also caused to turn counterclockwise by virtue of frictional force. In the absence of a special arrangement, these two angular speeds will not be equal to each other. At the conclusion of the preliminary grinding and the precision grinding, curvature of the lens is almost in line with the requirement. The workpiece is finally polished in such a manner that the polishing is done from the fringe of the workpiece toward the central part of the workpiece, and that curvature of the workpiece conforms to specifications. The grinding process and the polishing process may last as long as thirty minutes. As far as the conventional method for grinding the optical lens is concerned, the wear is greater at the fringes of the workpiece than at the inner part of the workpiece.

The grinding technology of the optical fiber end was developed two decades ago from the conventional method for grinding the optical lens. The grinding process of the optical fiber end is carried out in such a manner that the optical fiber is attached to the ring, and the holder of the optical fiber end must be stationary. In light of the relative motion of the workpiece and the grinding tray of the conventional method for grinding the optical lens, the grinding surface must be caused to engage in a movement or rotation of other form in relation to the optical fiber end holder in addition to its self-revolution, as shown in the U.S. Pat. Nos. 4,831,784; 4,905,415; 4,979,334; and 5,458,531. The most commonly-used grinding tray movement is illustrated in FIG. 2 in which the reference numerals 3, 4, and 5 denote respectively an optical fiber end holder, self-revolution of a grinding surface, eccentric rotation of the grinding surface. The prior art methods for grinding the optical fiber end are technically similar to the conventional method for grinding the optical lens such that the wear is greater at the fringe of the optical fiber end than the inner part of the optical fiber end.

The precision grinding and the polishing of the optical fiber end are done on an elastic grinding surface, as illustrated in FIG. 3 in which the reference numerals 7, 8, and 9 denote respectively a workpiece, a pressure, and an elastic grinding surface. The elastic grinding surface 9 is exerted on by the pressure 8 such that the elastic grinding surface 9 is caused to have a depression by means of which the workpiece 7 is so shaped as to have a convex surface. In view of the fact that the workpiece to be shaped by the elastic grinding surface is relatively small in size, the time that is required for the preliminary grinding, the precision grinding and the polishing lasts less than thirty seconds, which are considerably short as compared with the conventional method for grinding the optical lens. It is therefore necessary that all optical fiber ends held by the holder must be subjected to the same grinding strength in a relatively short period of time. In other words, the optical fiber ends are located at positions which are equal in grinding strength to one another. For example, twelve optical fiber ends are arranged along the circumference of a round holder such that all optical fiber ends are exerted on by the same pressure, thereby resulting in the shaping of all optical fiber ends in a uniform manner. Such a control method is respectively disclosed in the U.S. Pat. Nos. 6,039,630; and 6,077,154. These prior art methods are limited in design in that the optical fiber end holder can accommodate only a few optical fiber ends, and that they are not suitable for use in mass production.

SUMMARY OF THE INVENTION

The primary objective of the present invention is to provide an equipment for shaping at the same time a plurality of workpiece ends such that the workpiece ends are provided with a convex surface. The equipment of the present invention comprises a workpiece end holder, an elastic grinding surface, a driving device, and a pressure device.

The workpiece end holder is designed to hold a plurality of workpiece ends such that the workpiece ends are substantially equal in height with reference to a horizontal plane of the holder.

The elastic grinding surface is used to grind and polish the workpiece ends.

The driving device is used to drive the holder or the elastic grinding surface to engage in an eccentric rotation of a constant orientation.

The pressure device is used to provide a predetermined pressure under which the workpiece ends are kept in contact with the elastic grinding surface throughout the time that the workpiece ends are being ground or polished by the elastic grinding surface.

Preferably, the equipment of the present invention further comprises one or more elastic grinding surfaces in addition to the elastic grinding surface whereby the elastic grinding surfaces are used to grind or polish the workpiece ends in conformity with various specifications, with the elastic grinding surfaces being driven by the driving device to engage in an eccentric rotation in a constant orientation such that the elastic grinding surfaces come in contact with the workpiece ends one after another under the same or different pressure provided by the pressure device.

Preferably, the equipment of the present invention further comprises one or more cleansing devices for cleansing the workpiece ends at the time when the workpiece ends are disengaged with the elastic grinding surfaces. Preferably, the cleansing devices are brushing surfaces, ultrasonic cleansing devices, or a combination of the brushing surfaces and the ultrasonic cleansing devices.

Preferably, the cleansing devices are elastic brushing surfaces, whereby the elastic brushing surfaces form with the elastic grinding surfaces a tape-shaped element such that the elastic brushing surfaces and the elastic grinding surfaces are serially arranged at intervals.

Preferably, the equipment of the present invention further comprises a grinding tray to which the elastic grinding surface is attached such that the grinding tray and the elastic grinding surface are driven at the same time by the driving device to engage in the eccentric rotation in the constant orientation.

Preferably, the holder and the elastic grinding surface are driven by the driving device to engage in the eccentric rotation at different speeds and in the constant orientation.

Preferably, the elastic grinding surface is driven to engage in a linear reciprocating motion.

Preferably, the elastic grinding surface is driven to engage in a linear reciprocating motion.

Preferably, the holder is driven to engage in a linear reciprocating motion.

Preferably, the holder and the elastic grinding surface are driven to engage in a linear reciprocating motion in different directions.

Preferably, the elastic grinding surface is provided with a plurality of holes, wherein the holes are uniformly arranged and have a hole diameter ranging between 0.1 mm and 4.0 mm.

Preferably, the elastic grinding surface and the grinding tray are provided at a center thereof with a center hole with a diameter ranging between 0.1 mm and 4.0 cm, wherein the center hole of the grinding tray does not penetrate through the grinding tray.

Preferably, the equipment of the present invention further comprises a vacuum suction system corresponding in location to the grinding tray, wherein the grinding tray is provided with a plurality of holes ranging in diameter from 0.1 mm to 4.0 mm, and the vacuum suction system is for removing grinding chips and grinding fluid, and for holding the elastic grinding surface by providing suction to the plurality of holes of the grinding tray.

Preferably, the equipment of the present invention further comprises a plurality of add-on elastic grinding surfaces, and a plurality of add-on holders identical to the holder, with some of the add-on holders or all of the add-on elastic grinding surfaces being driven by the driving device to engage in the eccentric rotation in the constant orientation such that a plurality of workpiece ends held by some of the add-on holders are kept in contact at the same time with the add-on elastic grinding surfaces under a predetermined pressure provided by the pressure device, thereby enabling the workpiece ends to be ground or polished in various degrees.

Preferably, the add-on elastic grinding surfaces comprise an elastic tape on which a grinding material or a polishing material is disposed, wherein the elastic tape is wound at both ends on two reels.

Preferably, the equipment of the present invention further comprises a plurality of cleansing devices for cleansing the workpiece ends, the cleansing devices being arranged at intervals along with the add-on elastic grinding surfaces thereby enabling the workpiece ends held by other portion of the add-on holders to be cleansed at the same time by the cleansing devices during the time that the workpiece ends held by the some of the add-on holders are being ground or polished.

Preferably, the equipment of the present invention further comprises a conveyer for transporting all of said holders such that the holders move past one after another all of the elastic grinding surfaces and all of the cleansing devices.

Preferably, the equipment of the present invention further comprises a conveyer for transporting intermittently all of the elastic grinding surfaces and all of the cleansing devices such that all of the elastic grinding surfaces and all of the cleansing devices move past one after another all of said holders.

Preferably, the equipment of the present invention further comprises a grinding tray on which all of the elastic grinding surfaces are disposed whereby said grinding tray and the elastic grinding surfaces are driven by the driving device to engage synchronously in the eccentric rotation in the constant orientation.

Preferably, the driving device drives portion of the holders and all of the elastic grinding surfaces to engage in the eccentric rotation at various speeds and in the constant orientation.

Preferably, the equipment of the present invention further comprises a grinding tray on which all of the elastic grinding surfaces and all of the cleansing devices are disposed, wherein the grinding tray is driven by the driving device to engage in the eccentric rotation in the constant orientation.

Preferably, all of the elastic grinding surfaces are provided with a plurality of holes ranging in diameter between 0.1 mm and 4.0 mm.

Preferably, all of the elastic grinding surfaces and the grinding tray are provided at a center thereof with a center trench ranging in width from 1 mm to 4 cm, wherein the center trench of said grinding tray does not penetrate through the grinding tray.

Preferably, the equipment of the present invention further comprises a plurality of containers, wherein the containers are disposed on the grinding tray such that all of the elastic grinding surfaces are held in the containers, with the containers serving to collect grinding chips and grinding fluids.

Preferably, the equipment of the present invention further comprises a plurality of containers, wherein the containers are disposed on the grinding tray such that all of the elastic grinding surfaces and all of the cleansing devices are held in the containers, with the containers serving to collect grinding chips, grinding fluids, and cleansing wastes.

The features, functions, and advantages of the present invention will be more readily understood upon a thoughtful deliberation of the following detailed description of the present invention with reference to the accompanying drawings.

DETAILED DESCRIPTION OF THE INVENTION

The present invention provides a grinding equipment with a grinding motion mode enabling a plurality of ground optic fiber ends to be instantaneously equal to one another in grinding speed and grinding direction. The grinding directions of the optic fiber ends are uniformly changed along with a change in time. In other words, the grinding equipment of the present invention is capable of a uniform grinding level in all directions.

Figure 1:
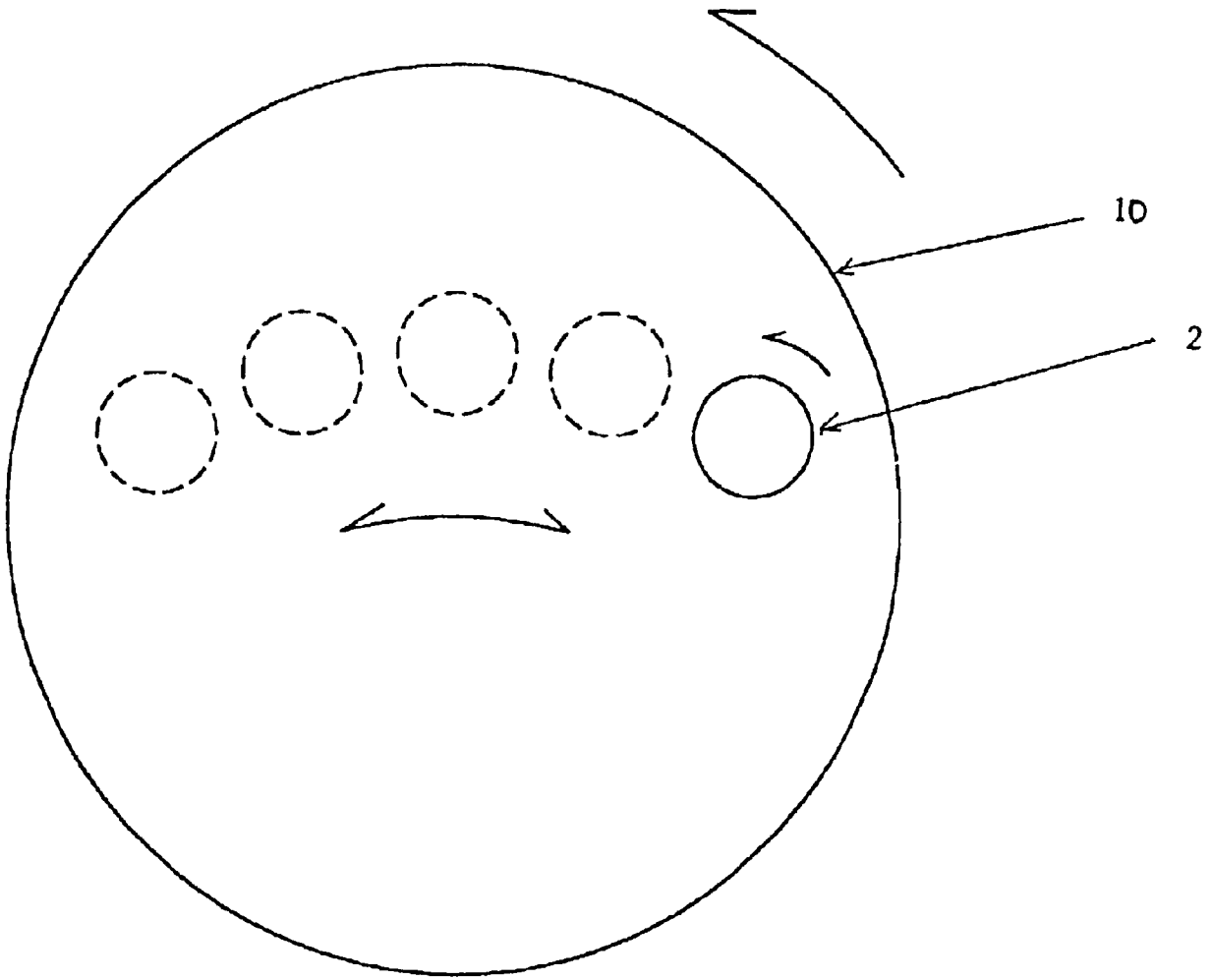
Fig. 1 (Prior Art)
FIG. 1 shows a schematic view of a conventional method for grinding an optical lens.
Figure 2:
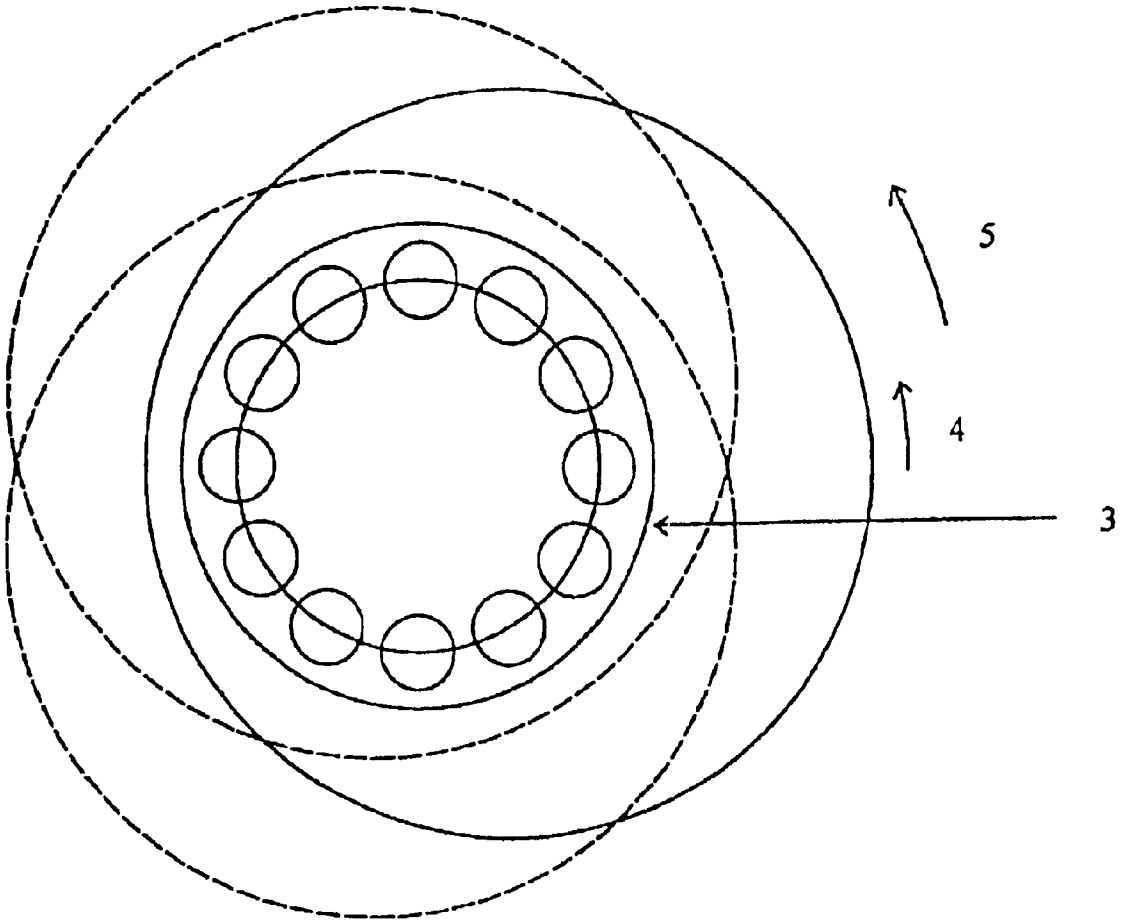
Fig. 2 (Prior Art)
FIG. 2 shows schematic view of the way by which a grinding tray of the conventional method is engaged in a motion.
Figure 3:
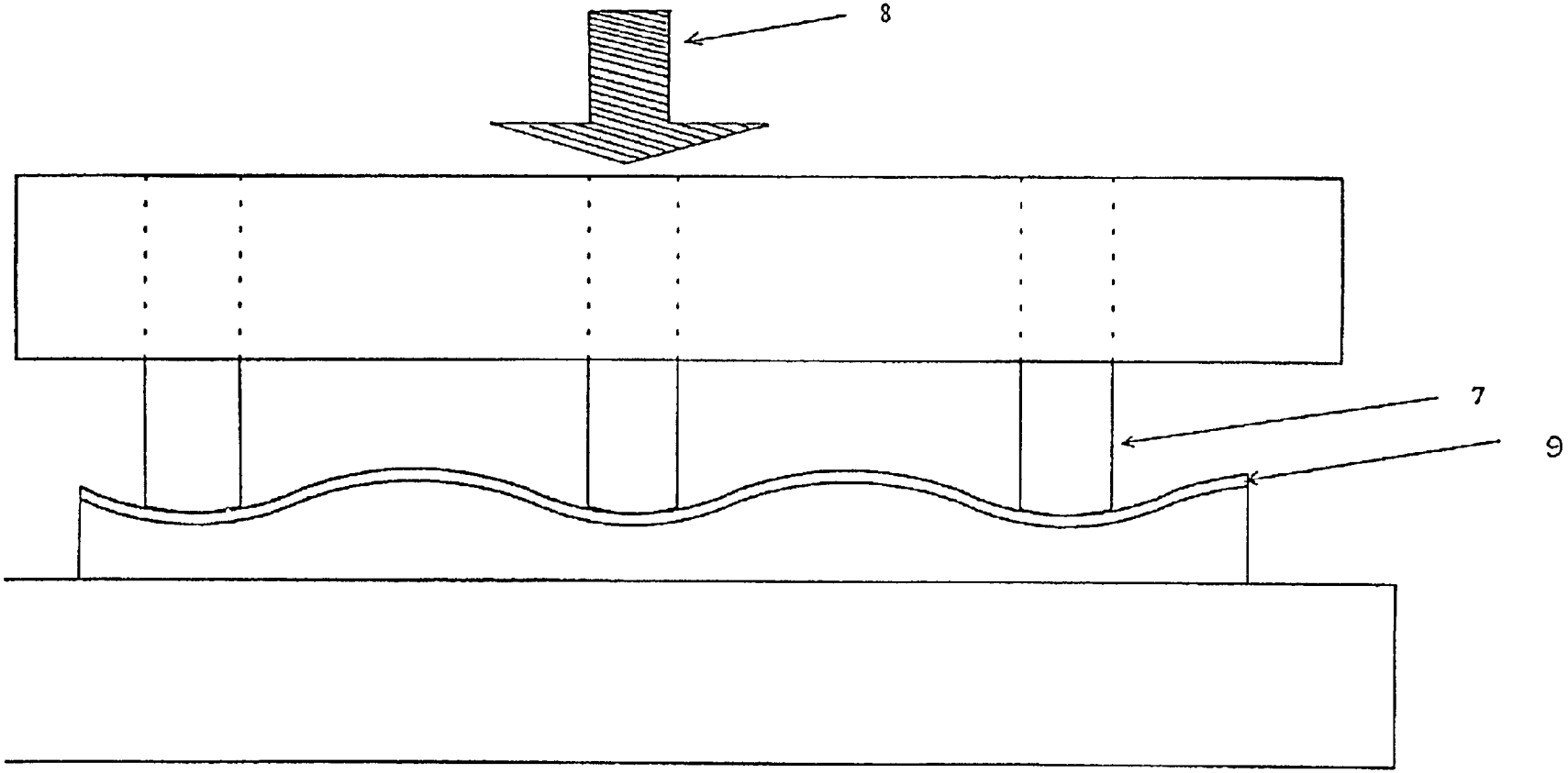
Fig. 3 (Prior Art)
FIG. 3 shows a schematic view of formation of a convex surface of a workpiece by an elastic grinding surface.
Figure 4:
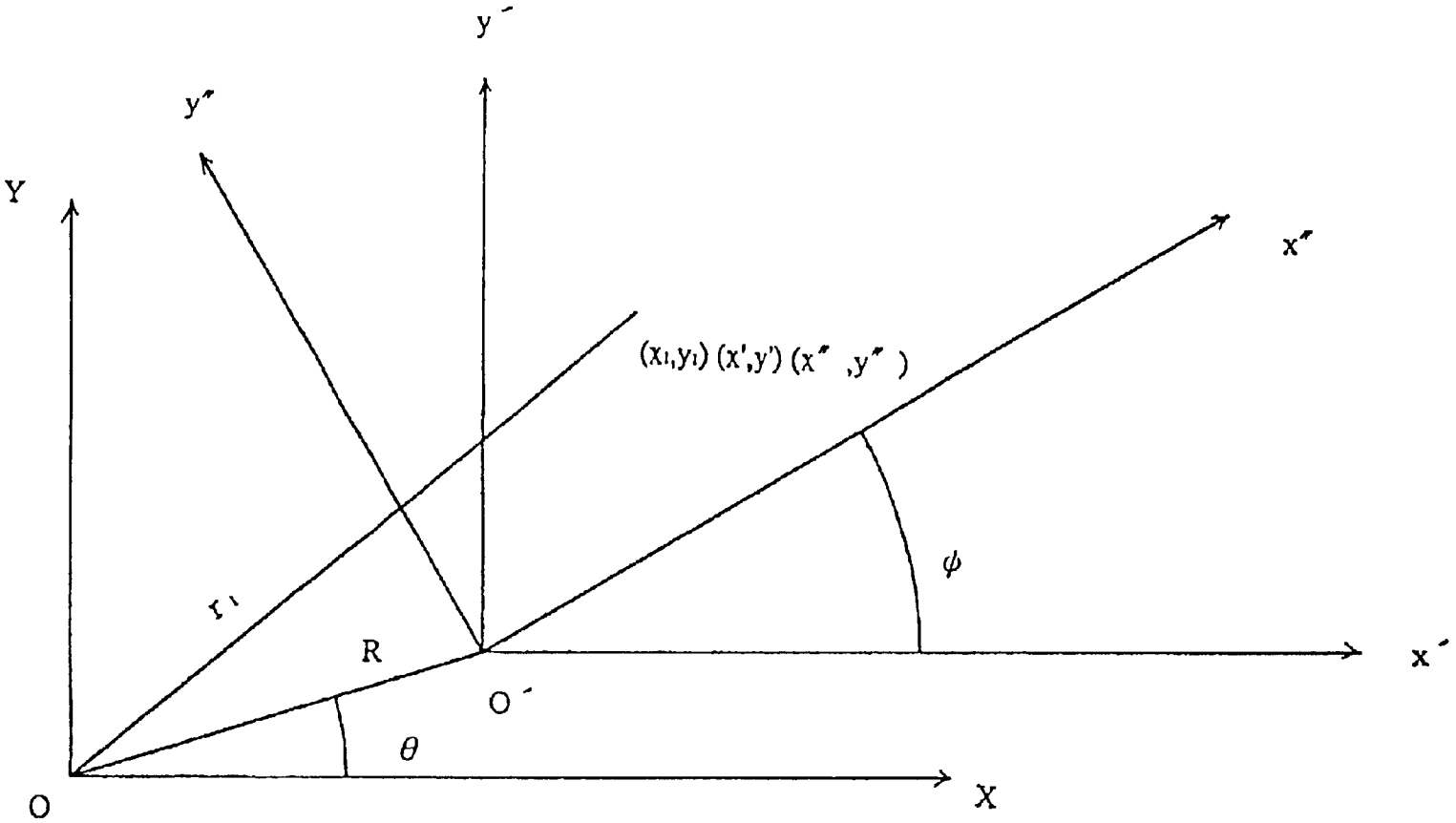
Fig. 4 (Prior Art)
FIG. 4 shows a Cartesian coordinates for the purpose of a mathematical analysis of the self-revolution and the eccentric rotation of the grinding surface of FIG. 2.

A mathematical analysis of the grinding motion of the prior art is first completed with reference to FIGS. 2 and 4.

As shown in FIG. 4, the XY Cartesian coordinates of the optical fiber holder of the prior art is stationary, with O being an original point of the stationary coordinates or a center point of optical fiber holder. The $r_1$ line represents a line connecting the center point O and a given point on the optical fiber holder. In other words, $r_1$ represents the position of an optical fiber end to be ground, with its coordinate point being $(X_1, Y_1)$. O' is the center of a circle around which the grinding surface is engaged in the self-revolution. R stands for a distance between the O point and the O' point. θ is the angle of the eccentric rotation at time t. ϕ is the angle of the self-revolution of the grinding surface at time t. O' is the original point of the x'y' coordinates of the eccentric rotation of the grinding surface while the grinding surface direction remains unchanged.

(x", y") is a given point on the grinding surface. If t=0, θ=0, and ϕ=0. At time t, $(x_1, y_1)$, (x', y') and (x", y") are on the same point. First of all, ask for the relationship of $(x_1, y_1)$ and (x", y") along with the time change.

$$\left.\begin{aligned} x'' &= x'\cos\phi + y'\sin\phi \\ y'' &= -x'\sin\phi + y'\cos\phi \end{aligned}\right\} \tag{1}$$

$$\left.\begin{aligned} x' &= x_1 - R\cos\theta \\ y' &= y_1 - R\sin\theta \end{aligned}\right\} \tag{2}$$

If equation (2) is substituted into equation (1), an equation (3) is obtained as follows:

$$\left.\begin{aligned} x'' &= (x_1 - R\cos\theta)\cos\phi + (y_1 - R\sin\theta)\sin\phi \\ y'' &= (y_1 - R\cos\theta)\sin\phi + (y_1 - R\sin\theta)\cos\phi \end{aligned}\right\} \tag{3}$$

If the angular speed of the eccentric rotation of the grinding surface $$\frac{d\theta}{dt} = \dot{\theta}$$

and the angular speed of the self-revolution $$\frac{d\varphi}{dt} = \dot{\phi}$$

are constant, the above equation may be written as follows:

$$\left.\begin{aligned} x'' &= (x_1 - R\cos\dot{\theta}t)\cos\dot{\phi}t + (y_1 - R\sin\dot{\theta}t)\sin\dot{\phi}t \\ y'' &= (x_1 - R\cos\dot{\theta}t)\sin\dot{\phi}t + (y_1 - R\sin\dot{\theta}t)\cos\dot{\phi}t \end{aligned}\right\} \tag{4}$$

In view of the fact that $\dot{\theta}$ and $\dot{\phi}$ are constant values, $x_1$ and $y_1$ are also constant values, therefore $$\begin{aligned} \frac{dx''}{dt} = \dot{x}'' = {} & -\dot{\phi}\sin\dot{\phi}t(x_1 - R\cos\dot{\theta}t) + (R\dot{\theta})\cos\dot{\phi}t\sin\dot{\theta}t + \\ & \dot{\phi}\cos\dot{\phi}t(y_1 - R\sin\dot{\theta}t) - R\dot{\theta}\sin\dot{\phi}t\cos\dot{\theta}t \end{aligned} \tag{5}$$

$$\begin{aligned} \frac{dy''}{dt} = \dot{y}'' = {} & -\dot{\phi}\cos\dot{\phi}t(x_1 - R\cos\dot{\theta}t) - (R\dot{\theta})\sin\dot{\phi}t\sin\dot{\theta}t + \\ & \dot{\phi}\sin\dot{\phi}t(y_1 - R\sin\dot{\theta}t) - R\dot{\theta}\cos\dot{\phi}t\cos\dot{\theta}t \end{aligned} \tag{6}$$

In view of the fact that (x", y") are coordinates of a point on the grinding surface at the time t, which is coincident on a point $(x_1, y_1)$ on the optical fiber end holder, and that $$\left(\frac{dx''}{dt}, \frac{dy''}{dt}\right)$$

is differential of this point coordinate relative to time, $$\left(-\frac{dx''}{dt}, -\frac{dy''}{dt}\right)$$

is the instantaneous speed of a point on the grinding surface which is on the point $(x_1, y_1)$ of the optical fiber end holder at the time t.

The following equation (7) is derived from the above equation (5).

$$\begin{aligned} (\dot{x}'')^2 = {} & \dot{\phi}^2\sin^2\dot{\phi}t(x - R\cos\dot{\theta}t)^2 + (R\dot{\theta})^2\dot{\phi}t\sin^2\dot{\theta}t\cos^2\dot{\phi}t + \\ & \dot{\phi}^2\cos^2\dot{\phi}t(y_1 - R\sin\dot{\theta}t)^2 + (R\dot{\theta})^2\sin^2\dot{\phi}t\cos^2\dot{\theta}t - \\ & 2\dot{\phi}R\dot{\theta}\sin\dot{\phi}t\cos\dot{\phi}t(x_1 - R\cos\dot{\theta}t)\sin\dot{\theta}t - \\ & 2\dot{\phi}^2\sin\dot{\phi}t\cos\dot{\phi}t(x_1 - R\cos\dot{\theta}t)(y_1 - R\sin\dot{\theta}t) + \\ & 2\dot{\phi}R\dot{\theta}\sin^2\dot{\phi}t(x_1 - R\cos\dot{\theta}t)\cos\dot{\theta}t + \\ & 2\dot{\phi}R\dot{\theta}\cos^2\dot{\phi}t\sin\dot{\theta}t(y_1 - R\sin\dot{\theta}t) - \\ & 2(R\dot{\theta})^2\sin\dot{\phi}t\cos\dot{\phi}t\sin\dot{\theta}t\cos\dot{\theta}t - \\ & 2\dot{\phi}R\dot{\theta}\sin\dot{\phi}t\cos\dot{\phi}t(y_1 - R\sin\dot{\theta}t)\cos\dot{\theta}t \end{aligned} \tag{7}$$

Average $(\dot{x}'')^2$ in relation to time. In light of the averages of $\sin\dot{\theta}t$, $\cos\dot{\theta}t$, $\sin\dot{\phi}t$, and $\cos\dot{\phi}t$ being zero in relation to time, the odd orders of sine, cosine of the equation (7) are zero in relation to time. As a result, equation (8) is obtained as follows:

$$\begin{aligned} \overline{(\dot{x}'')^2} = {} & \dot{\phi}^2\sin^2\dot{\phi}t(x_1 - R\cos\dot{\theta}t)^2 + (R\dot{\theta})^2\cos^2\dot{\phi}t\sin^2\dot{\theta}t + \\ & \dot{\phi}^2\cos^2\dot{\phi}t(y_1 - R\sin\dot{\theta}t)^2 + (R\dot{\theta})^2\sin^2\dot{\phi}t\cos^2\dot{\theta}t - \\ & 2\dot{\phi}R^2\dot{\theta}\sin^2\dot{\phi}t\cos^2\dot{\theta}t - 2\dot{\phi}R^2\dot{\theta}\cos^2\dot{\phi}t\sin^2\dot{\theta}t \end{aligned} \tag{8}$$

Similarly, equation (9) is obtained as follows:

$$\begin{aligned} \overline{(\dot{y}'')^2} = {} & \dot{\phi}^2\cos^2\dot{\phi}t(x_1 - R\cos\dot{\theta}t)^2 + (R\dot{\theta})^2\sin^2\dot{\phi}t\sin^2\dot{\theta}t + \\ & \dot{\phi}^2\sin^2\dot{\phi}t(y_1 - R\sin\dot{\theta}t)^2 + (R\dot{\theta})^2\cos^2\dot{\phi}t\cos^2\dot{\theta}t - \\ & 2\dot{\phi}R^2\dot{\theta}\cos^2\dot{\phi}t\cos^2\dot{\theta}t - 2\dot{\phi}R^2\dot{\theta}\sin^2\dot{\theta}t\sin^2\dot{\theta}t \end{aligned} \tag{9}$$

The square of the average speed of the point (x",y") on the grinding surface passing the point $(x_1, y_1)$ on the optical fiber end holder is therefore as follows:

$$\begin{aligned} \overline{(\dot{x}'')^2} + \overline{(\dot{y}'')^2} &= \overline{(\dot{x}'')^2} + \overline{(\dot{y}'')^2} \\ &= \dot{\phi}^2(\sin^2\dot{\phi}t + \cos^2\dot{\phi}t)(x_1 - R\cos\dot{\theta}t)^2 + \\ & (R\dot{\theta})^2(\sin^2\dot{\phi}t + \cos^2\dot{\phi}t)\sin^2\dot{\theta}t + \end{aligned} \tag{10}$$

-continued $$\begin{aligned}
&\overset{*}{\phi}^2\left(\sin^2\overset{*}{\phi}t+\cos^2\overset{*}{\phi}t\right)\left(y_1-R\sin\overset{*}{\theta}t\right)^2+\\
&\left(R\overset{*}{\theta}\right)^2\left(\sin^2\overset{*}{\phi}t+\cos^2\overset{*}{\phi}t\right)\cos^2\overset{*}{\theta}t-\\
&2\overset{*}{\phi}R^2\overset{*}{\theta}\left(\sin^2\overset{*}{\phi}t+\cos^2\overset{*}{\phi}t\right)\cos^2\overset{*}{\theta}t-\\
&2\overset{*}{\phi}R^2\overset{*}{\theta}\left(\sin^2\overset{*}{\phi}t+\cos^2\overset{*}{\phi}t\right)\sin^2\overset{*}{\theta}t\\
&=\overset{*}{\phi}^2\left(x_1-R\cos\overset{*}{\theta}t\right)^2+\overset{*}{\phi}^2\left(y_1-R\sin\overset{*}{\theta}t\right)^2+\\
&\left(R\overset{*}{\theta}\right)^2\left(\sin^2\overset{*}{\theta}t+\cos^2\overset{*}{\theta}t\right)-\\
&2\overset{*}{\phi}R^2\overset{*}{\theta}\left(\sin^2\overset{*}{\theta}t+\cos^2\overset{*}{\theta}t\right)\\
&=\overset{*}{\phi}^2(x_1^2+y_1^2)+\overset{*}{\phi}^2R^2-2\overset{*}{\phi}x_1R\cos\overset{*}{\theta}t-\\
&2\overset{*}{\phi}y_1R\sin\overset{*}{\theta}t+\left(R\overset{*}{\theta}\right)^2-2\overset{*}{\phi}R^2\overset{*}{\theta}
\end{aligned}$$

Because of the averages of cos $\dot{\theta}$ t and sin $\dot{\theta}$ t being zero in relation to time, equation (11) is obtained as follows:

$$\begin{aligned}
\dot{x}''^2+\dot{y}''^2&=\dot{\phi}^2r_1^2+\dot{\phi}^2R^2+\dot{\theta}^2R^2-2\dot{\phi}R^2\dot{\theta}\\
&=r_1^2\dot{\phi}^2+R^2(\dot{\phi}-\dot{\theta})^2
\end{aligned}\tag{11}$$

The first item on the right side of the equal sign of the above equation (11) is related to the position of the optical fiber end holder, with the second item being irrelevant to the position of the optical fiber end holder. $\dot{\phi}$ is angular speed of self-revolution and $\dot{\theta}$ is angular speed of eccentric rotation of the grinding surface.

According to the above equation (11), when the angular speed of the self-revolution of the grinding surface becomes greater, the degree of the grinding on various points on the optical fiber end holder becomes less uniform. In other words, the self-revolution of the grinding surface is apt to have an adverse effect on the grinding uniformity of various points of the optical fiber end holder. However, the grinding degree is uniform on all points which are equal on $r_1$. That is to say that the grinding degree is uniform on all points of the circumference of a circle whose center is the center point of the eccentric rotation. For this reason, the conventional grinding method calls for the arrangement of all optical fiber ends on the circumference of the optical fiber end holder.

If $\dot{\phi}=0$, $\dot{\theta}\neq 0$, the grinding surface is capable of eccentric rotation and is incapable of self-revolution.

The following equation (12) is derived from the equations (5) and (6).

$$\left.\begin{aligned}
\dot{x}''&=R\dot{\theta}\sin\dot{\theta}t=-(x\text{ direction component of each point velocity of grinding surface})\\
\dot{y}''&=R\dot{\theta}\cos\dot{\theta}t=-(y\text{ direction component of each point velocity of grinding surface})
\end{aligned}\right\}\tag{12}$$

The following equation (13) is derived from the above equation (12).

$$((\dot{x}'')^2+(\dot{y}'')^2)^{1/2}=R\dot{\theta}\tag{13}$$

According to the above equations (12) and (13), all points of the grinding surface are instantaneously engaged in a motion in the same direction and at the same speed R $\dot{\theta}$. The direction is changed 360° at the constant speed along with time, with the angular speed being $\dot{\theta}$.

In light of the optical fiber ends being arranged in the circumference of a holder, the grinding operation is done in a small-scale manner. Such a technical handicap is shared by all grinding operations in which all workpieces are forced to make contact with an elastic grinding surface so as to form a convex surface on the workpieces. For example, the optical fiber connector, GRIN lens of the optical fiber communication, and the magnetic read/write head can not be produced in a large-scale. operation.

The above technical limitation can be overcome by controlling the pressure by which the workplaces are forced to make contact with the grinding surface, and by controlling the grinding surface in such a manner that the speed of the self-revolution of the grinding surface is reduced to zero or a value much smaller than the speed of the eccentric rotation of the grinding surface. In the case of the grinding method as shown in FIG. 2, the technical limitation can be overcome by adjusting the motor speed in such a way that the angular speed of self-revolution is reduced to zero or almost zero. However, the speed adjustment is a time-consuming chore and must be done only by an experienced technician. In other words, a superior mechanical design should not call for such an adjustment and should provide means to enable the grinding tray to engage in only eccentric rotation, thereby making a mass production possible.

Figure 6:
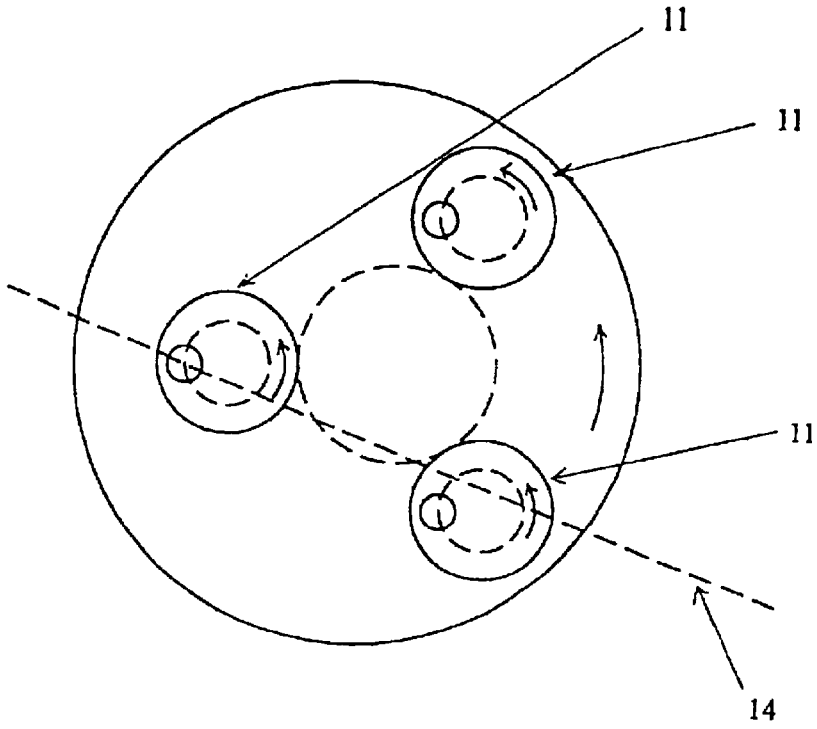
FIG. 6 shows a top plan view of the grinding equipment of the first preferred embodiment of the present invention, with the grinding tray being removed from the equipment.
Figure 5:
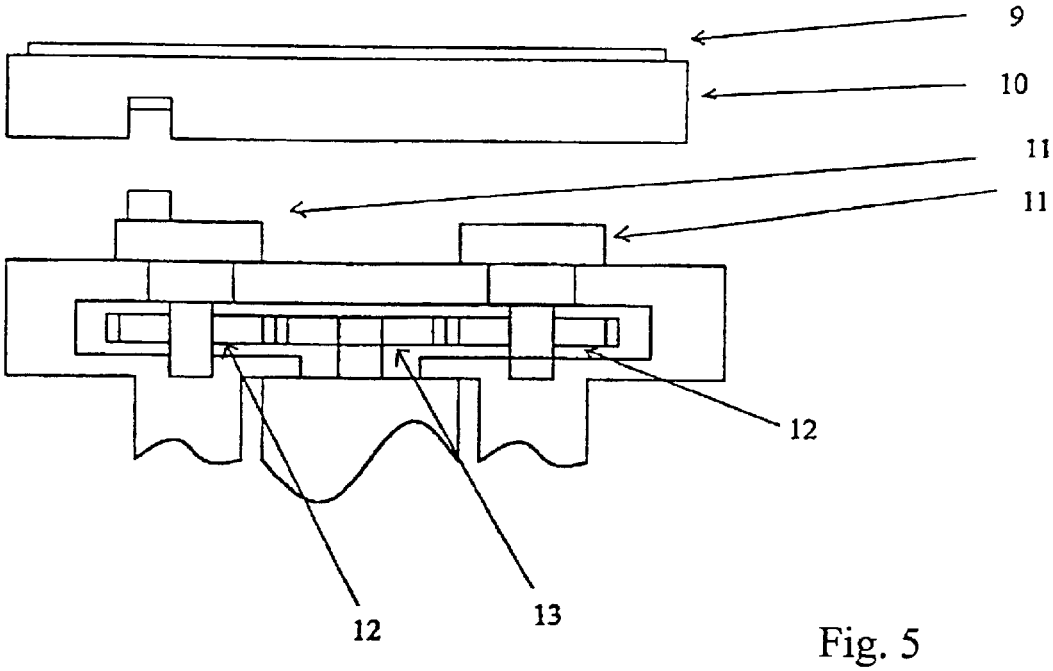
FIG. 5 shows a sectional schematic view of a grinding equipment of a first preferred embodiment of the present invention, with the sectional schematic view being taken along a line 14 as shown in FIG. 6.

As shown in FIG. 5, the grinding equipment of the first preferred embodiment of the present invention comprises a grinding surface 9, a grinding tray 10, a transmission wheel 11 by which the grinding tray 10 is caused to engage in an eccentric rotation, and two gears 12 and 13. The second gear 13 is driven by the motor so as to actuate the first gear 12, thereby enabling the transmission wheel 11 to turn to actuate the grinding tray 10 to engage in the eccentric rotation. As shown in FIG. 6, three transmission wheels turn at a constant speed and in the same direction, so as to enable the grinding tray to engage in only the eccentric rotation.

Figure 7:
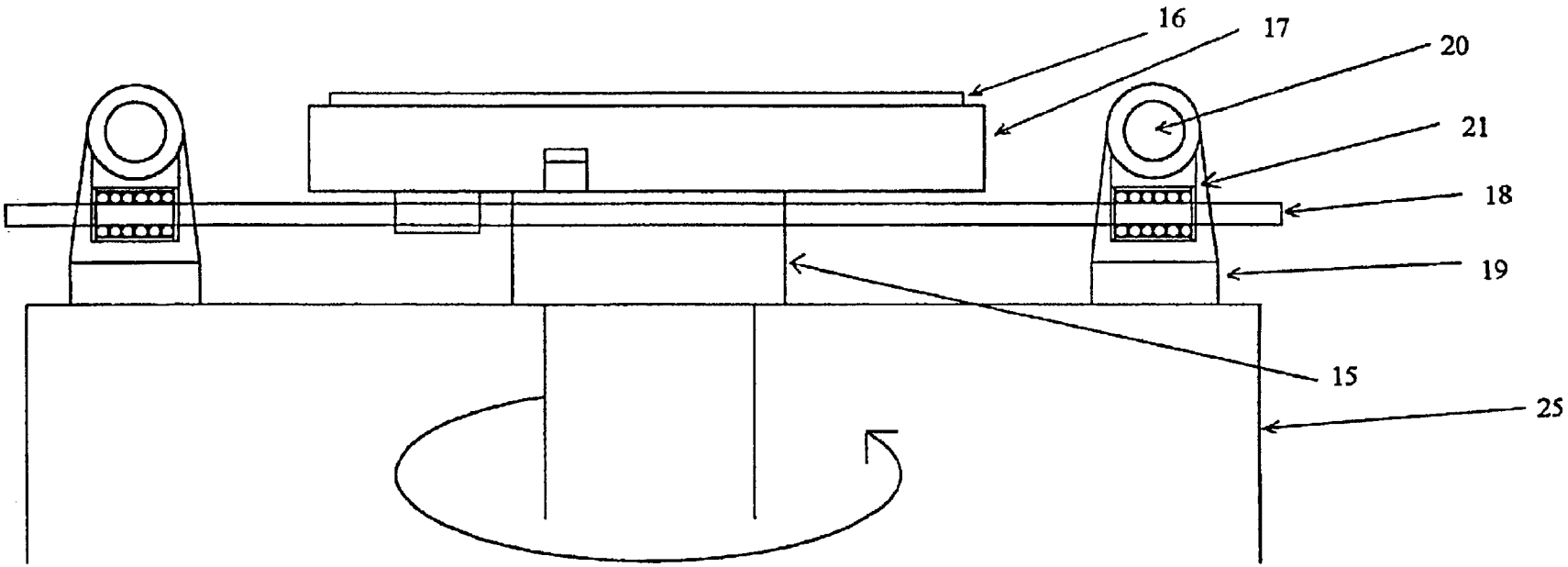
FIG. 7 shows a sectional schematic view of a grinding equipment of a second preferred embodiment of the present invention.
Figure 8:
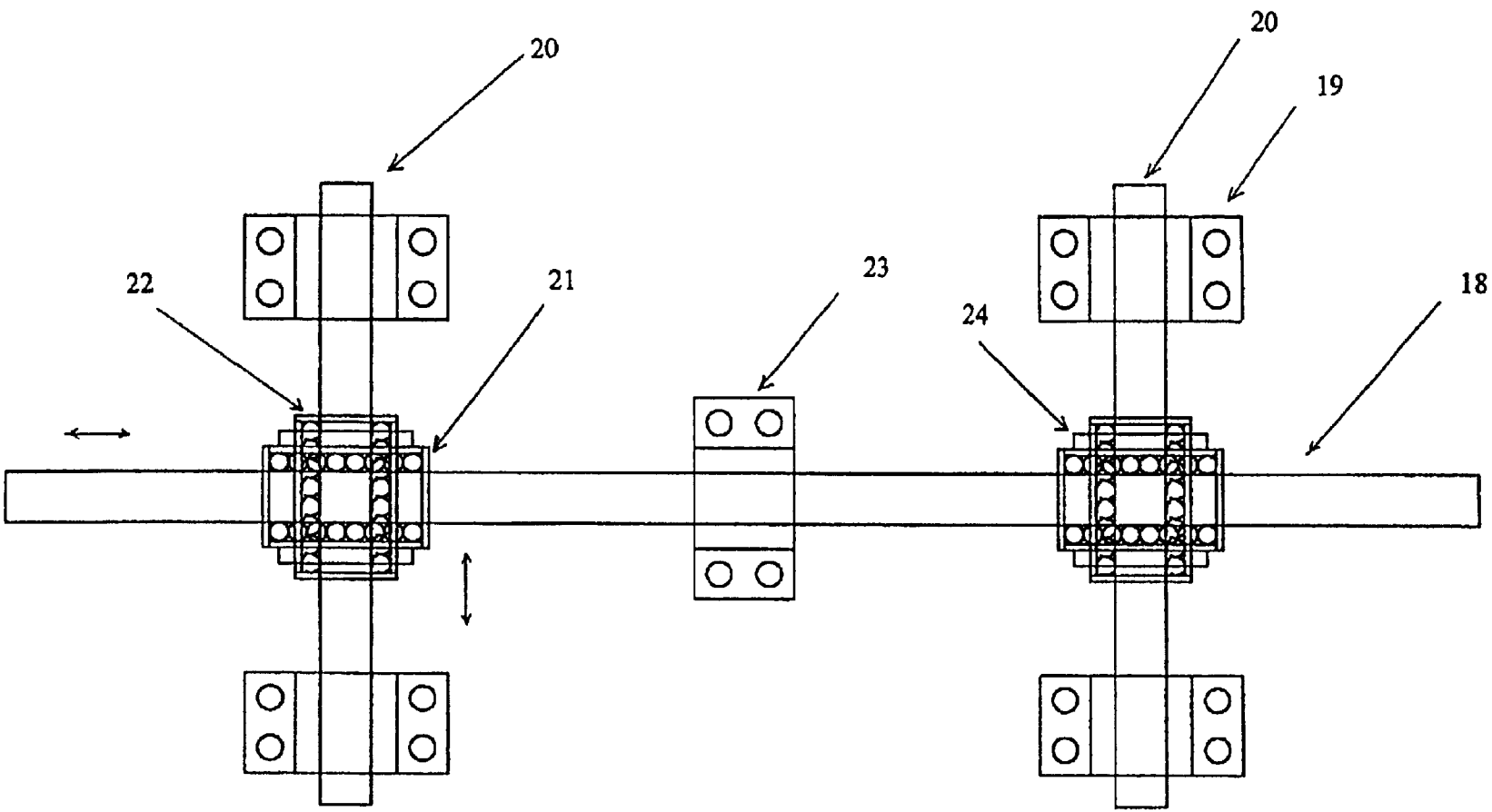
FIG. 8 shows a top view of a mechanical assembly for locating the grinding tray of the grinding equipment of the second preferred embodiment of the present invention, with certain elements being transparent to show the guide rod inserted thereinto.
Figure 9:
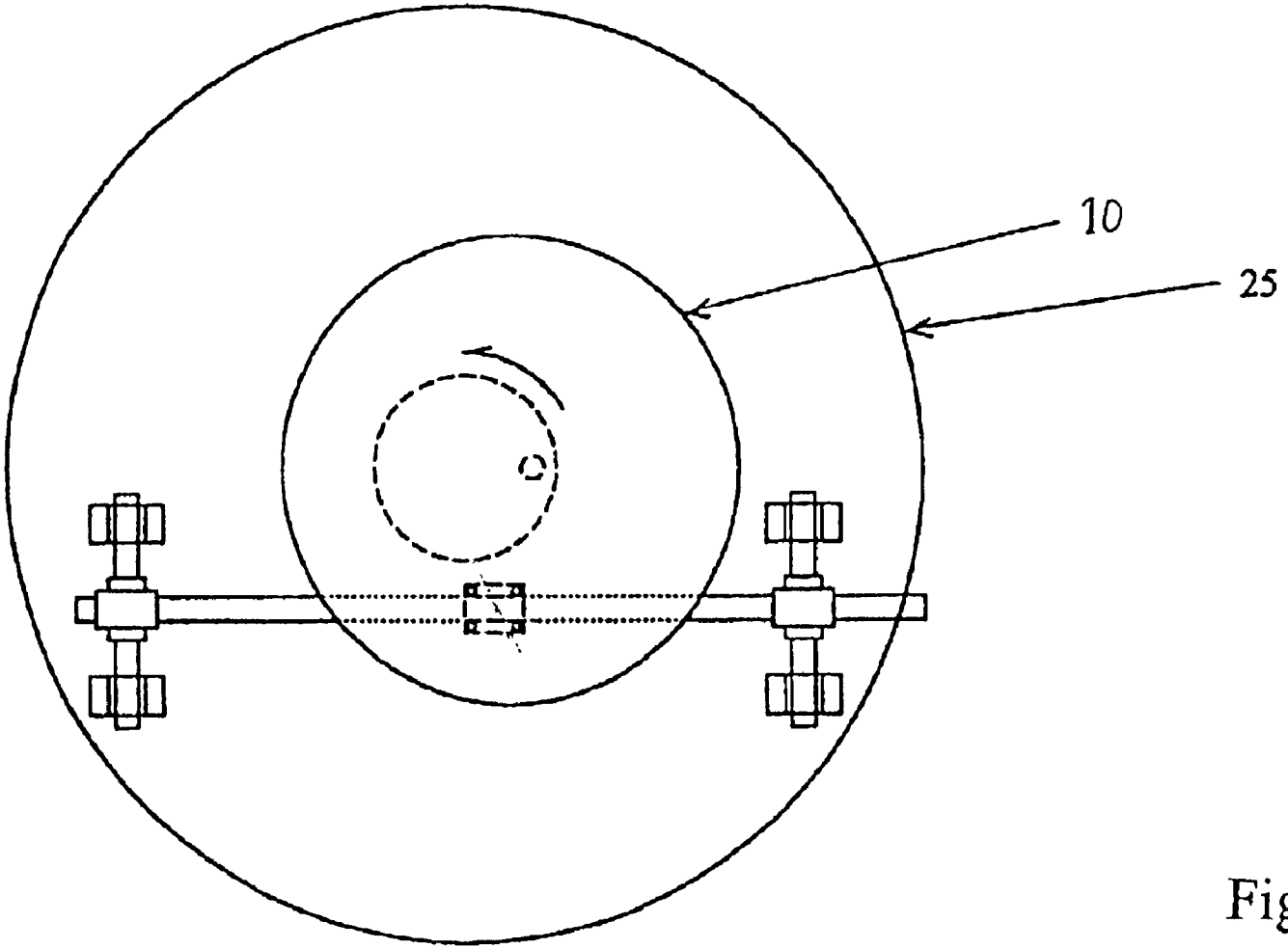
FIG. 9 shows a top view of the grinding equipment of the second preferred embodiment of the present invention.

As shown in FIGS. 7 and 9, the grinding equipment of the second preferred embodiment of the present invention comprises an eccentric transmission wheel 15, a grinding surface 16, a grinding tray 17, a base 25, with 18, 19, 20, 21 being a mechanical assembly for stopping the self-revolution of the grinding tray 17. As shown in FIG. 8, the mechanical assembly contains a movable linear ball guide rod 18, a guide rod fastening seat 19, a fixed linear ball guide rod 20 and a horizontal straight line ball bearing 21. A grinding tray fastening seat 23 is used for fastening the grinding tray 17 and the movable linear ball guide rod 18 together. A longitudinal straight line ball bearing 22 and the horizontal straight line ball bearing 21 are joined together by a linear bearing fastening seat 24 such that they are perpendicular to each other. Depending on the circumstance, the grinding tray may be provided with a plurality of the constant direction assemblies. In addition, when the eccentric rotation speed is too fast, the other side of the eccentric rotation is provided with a sufficient weight to compensate the rotational stability so as to prevent vibration.

Another technical consideration is the problem of the wear uniformity of the grinding surface. If certain portions of the grinding tray are incapable of grinding the ends in the grinding process, while other portions of the grinding tray are kept grinding the ends of the workpieces, there will be a substantial consumption of the material and a high rejection rate of the product.

Figure 10:
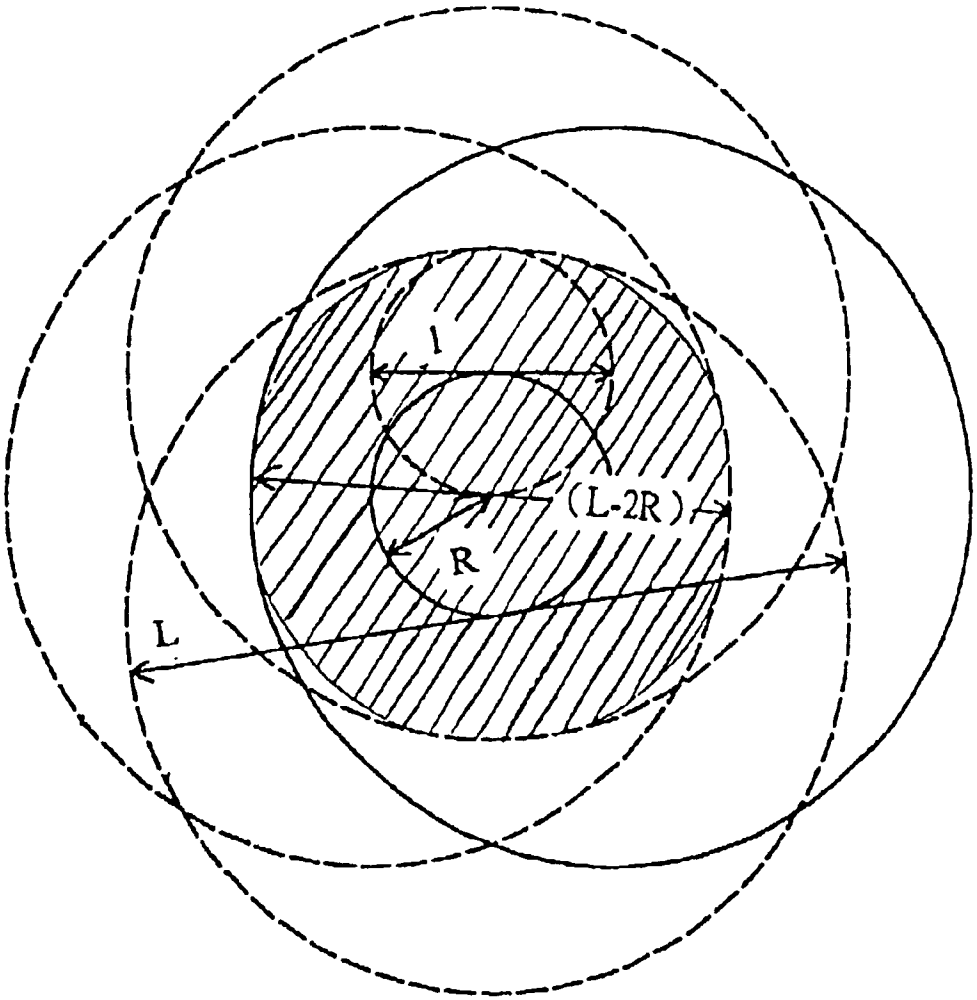
FIG. 10 shows a schematic view of the rotational radius of the eccentric rotation of the grinding surface of the grinding equipment of the present invention.
Figure 11:
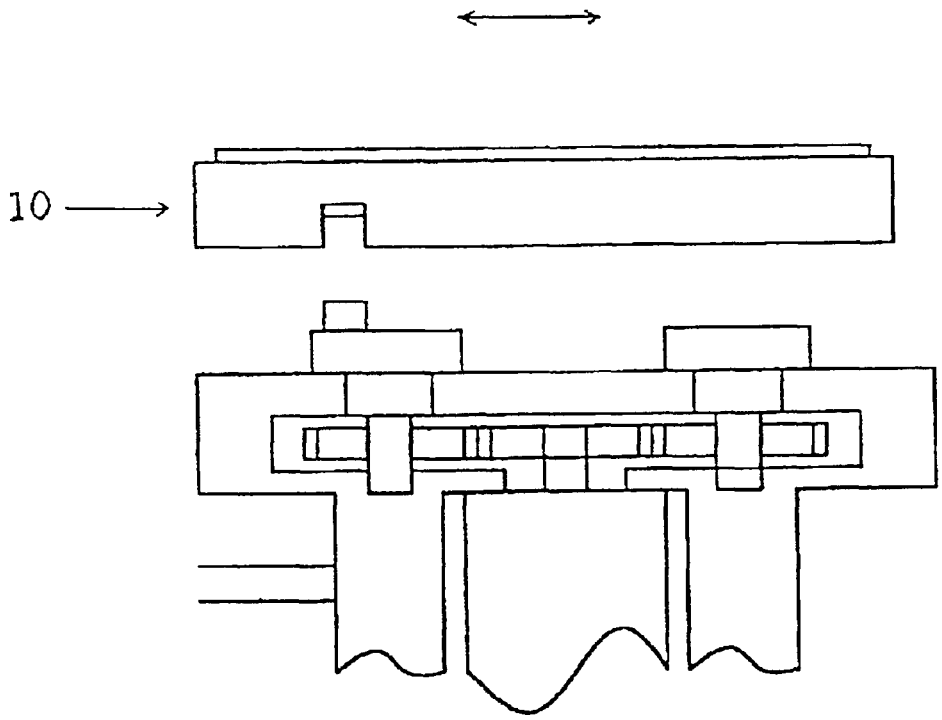
FIG. 11 shows a sectional schematic view of the direction of a linear reciprocating motion of the grinding equipment of the present invention.
Figure 12:
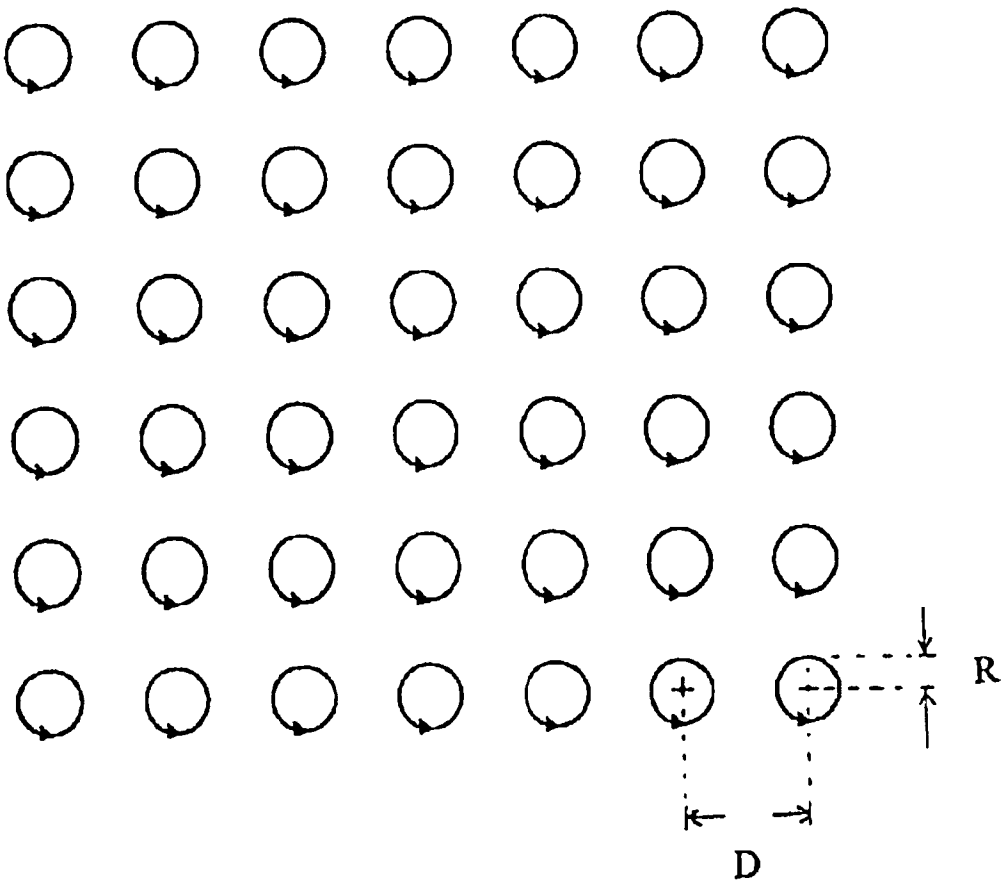
FIG. 12 shows a schematic view of the motion paths of the optical fiber ends, which is viewed from the grinding tray of the grinding equipment of the present invention to show that each of the optical fiber ends moves around a fixed point to form a circular path having a radius $R_1$ and that the optical fibers are arranged at an interval D, with D being greater than 2R (D>2R).
Figure 13:
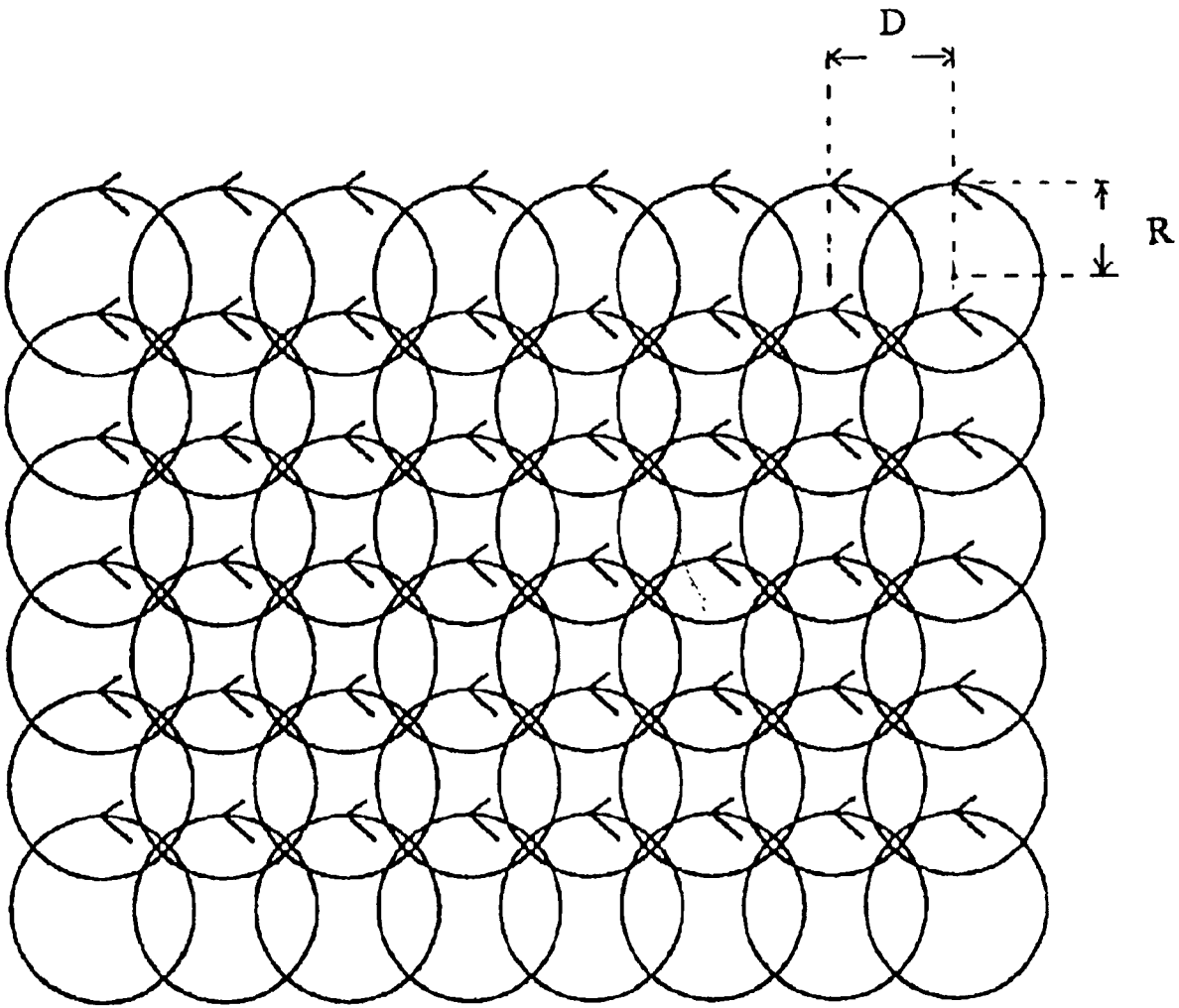
FIG. 13 shows a schematic view of the motion paths of the optical fiber ends on the grinding tray of the grinding equipment of the present invention, with the schematic view being taken from the grinding tray to show that each optical fiber end moves around a fixed point to form a circular path having a radius R, and that the optical fibers are arranged at an interval D which is smaller than 2R (D<2R).

A shown in FIG. 10, L is a grinding tray diameter. R is the radius of a circle around which the grinding tray is engaged in the eccentric rotation. The optical fiber end holder can be held only in the O area of the inclined line, or in a circle having a diameter of L-2R. The optical fiber end holder has a diameter l and is held in the fringe of the inclined line area. With l≦L/2, the center to (L/2 −) of the grinding surface are not being ground. The extent of wear from (L/2−l) to L/2 is proportional to $$\frac{\cos^{-1}\left(\frac{4x^2+(L-l)^2-l^2}{4x(L-l)}\right)}{\pi} \tag{14}$$

wherein x is a distance between a given position on the grinding surface and the center point of the grinding surface. The different positions on the grinding surface are different in wear. In the grinding process, if the grinding tray 10 or the optical fiber holder is provided with a linear reciprocating motion, as shown in FIG. 11, the wear of the grinding surface will be more uniform. With respect to the speed of the eccentric rotation, the linear reciprocating motion speed is small and negligible. Another consideration is the relationship between the optical fibers distribution interval on the end holder and the eccentric rotational radius of the grinding tray. Each optical fiber end encircles a fixed point serving as a center of a circle with a radius R from the view of the grinding tray, as shown in FIG. 12. If the optical fiber interval is D, D is greater than 2R, as shown in FIG. 12, only a portion of the grinding surface is being ground. If D<2R, as shown in FIG. 13, the grinding surface is uniformly ground.

Figure 14:
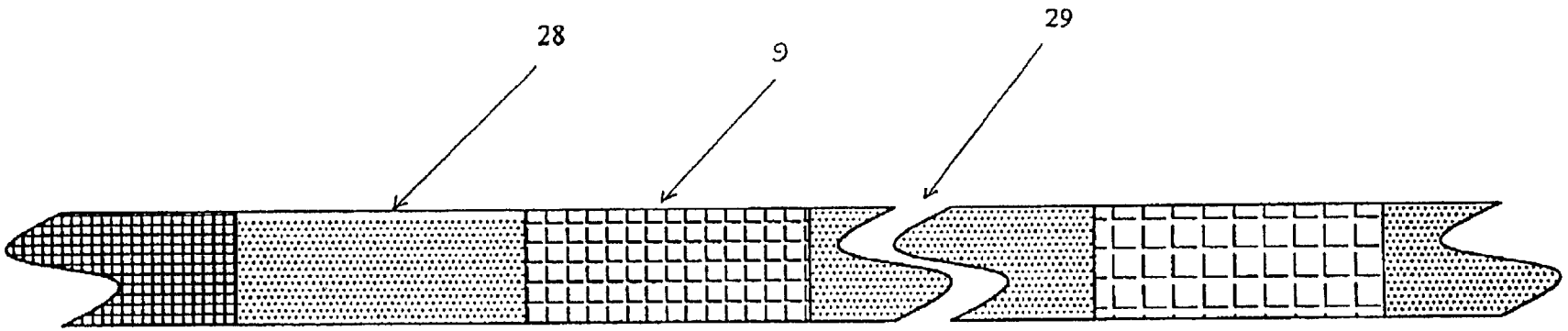
FIG. 14 shows a schematic plan view of a long elastic tape suitable for use in the present invention, with the long elastic tape being formed of a plurality of grinding surfaces and a plurality of brushing surfaces, which are arranged in series.
Figure 15:
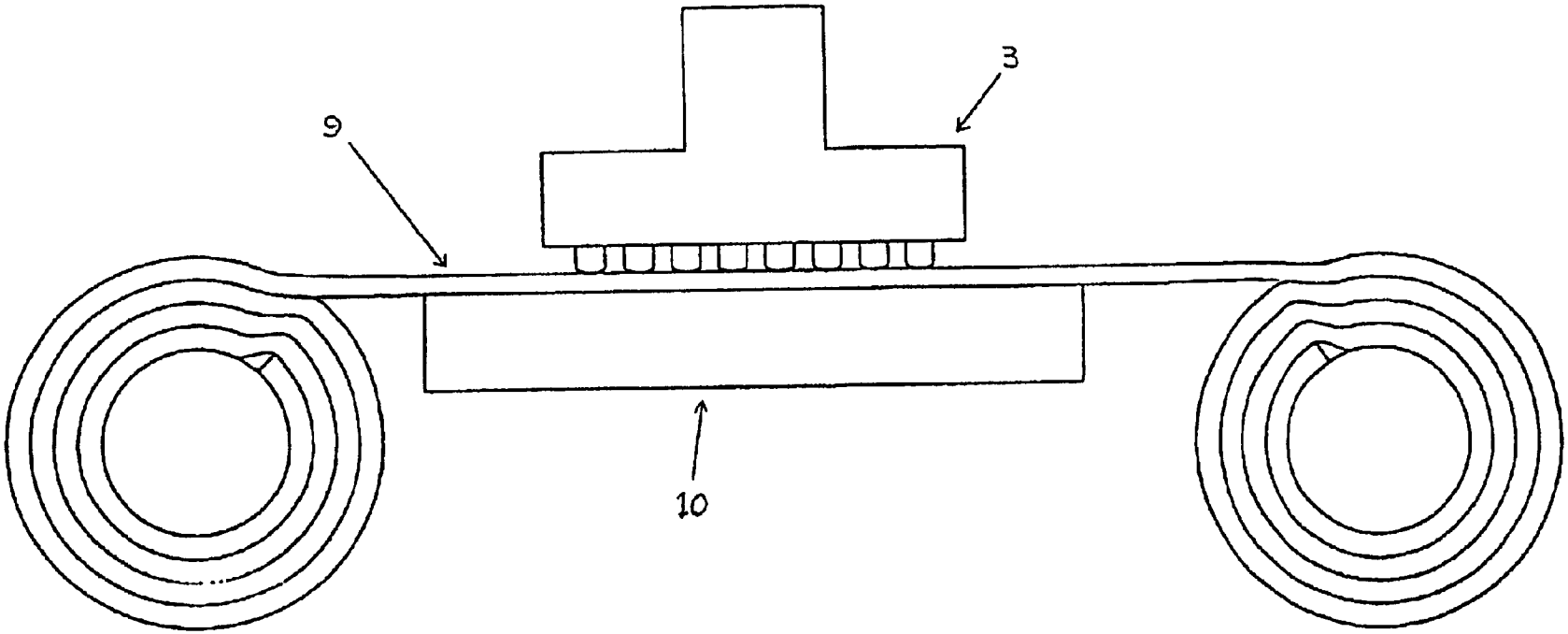
FIG. 15 shows a sectional schematic view of a grinding equipment of a third preferred embodiment of the present invention, with both ends of a long elastic tape being wound on a spool such that the long elastic tape runs through a space located between an optical fiber holder and a grinding tray.

If the entire operational flow is carried out on a machine, the grinding surfaces of various grain densities must be used throughout the entire operational flow. As a result, the operation can not be easily automated. Since the end holder is stationary while the grinding process is carried out by the grinding surface which is engaged in the eccentric rotation along with the grinding tray in the present invention, a long elastic strap is designed, as shown in FIG. 14. The long elastic strap is provided with a plurality of portions different in grain density for preliminary grinding, precision grinding, and polishing. As shown in FIG. 14, 9 is the grinding surface, 28 is the brushing surface, and 29 represents portions having various functions. The grinding surfaces of various grain densities are separated by the brushing surface. The elastic grinding surface 9 is rolled into two cylindrical bodies, as shown in FIG. 15, with the middle portion passing a grinding tray 10 to grind the optical fiber ends which are held by a holder 3. The grinding tray is provided with a vacuum means to attract the elastic grinding surface. Each time when the grinding surfaces of different grain densities are replaced, the motor is used to draw out of the spools to facilitate the replacing of the grinding surfaces. Located between the two grinding surfaces of different grain densities is a brushing surface. The motor is mounted at the side of the grinding tray such that the motor is in motion along with the grinding tray.

Figure 16:
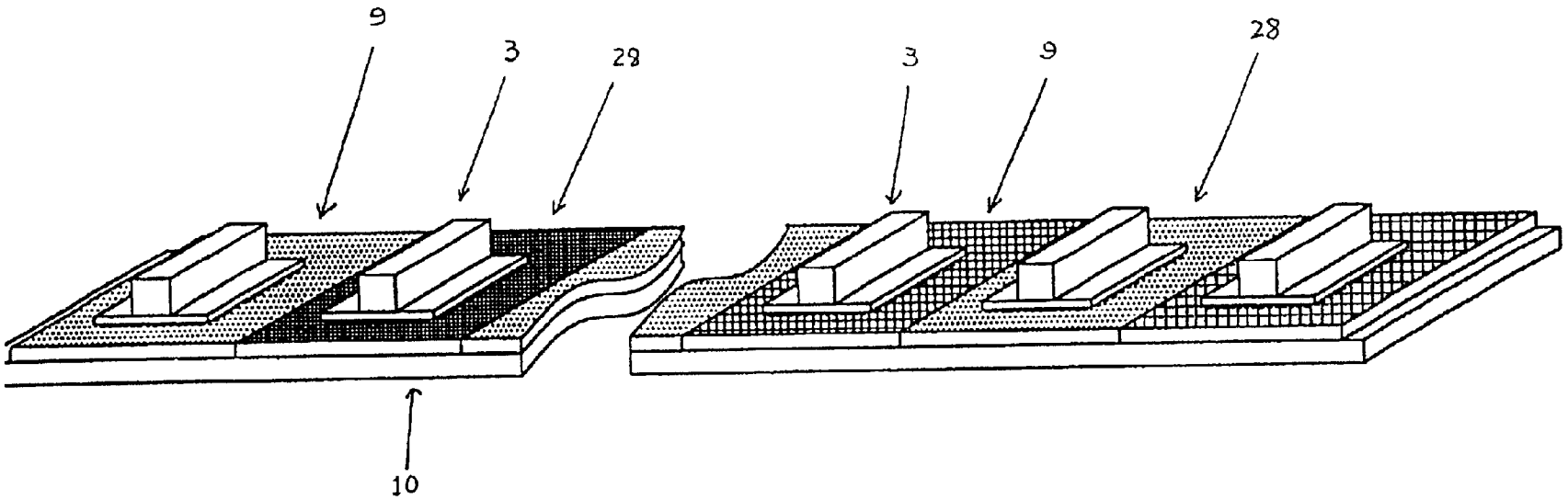
FIG. 16 shows a perspective view of a grinding equipment of a fourth preferred embodiment of the present invention.
Figure 17:
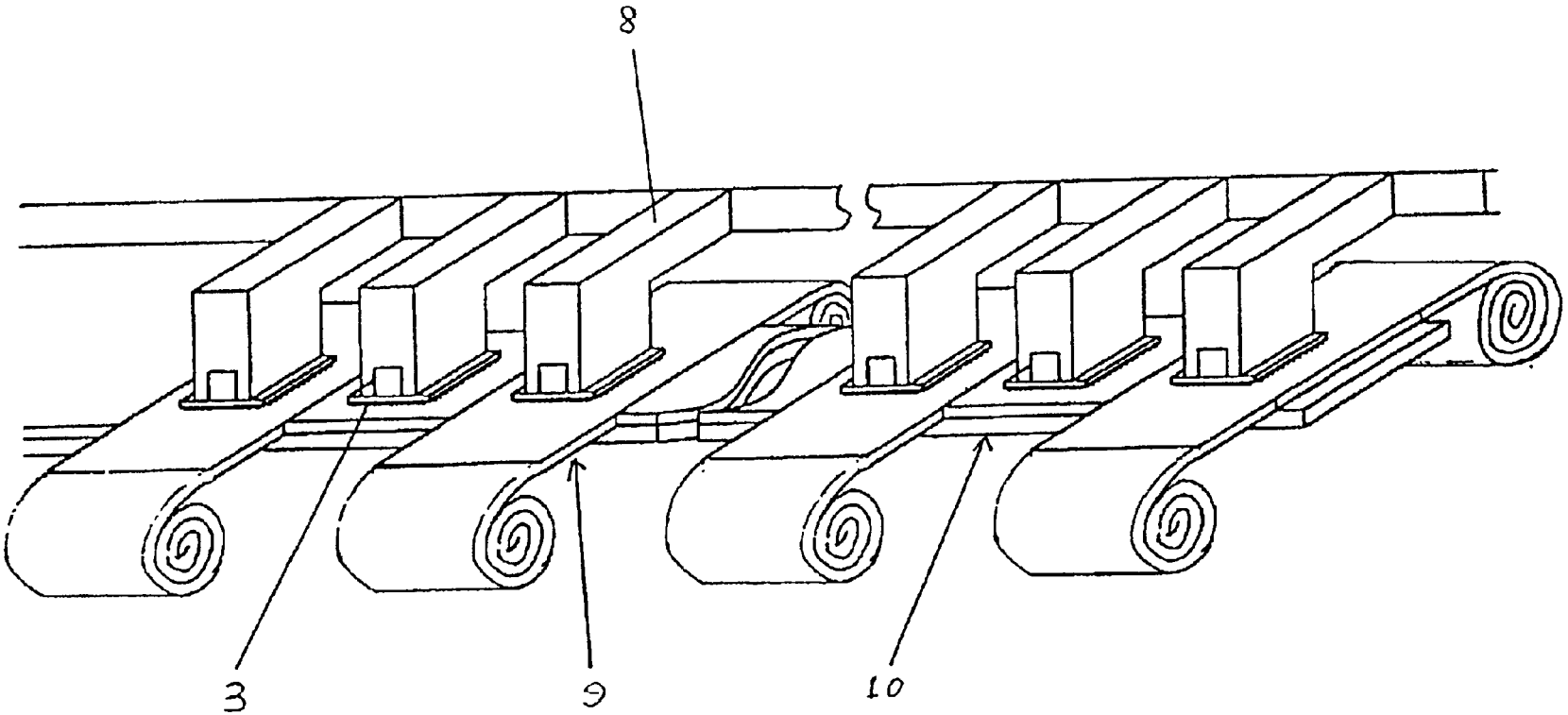
FIG. 17 shows a perspective view of a grinding equipment of a fifth preferred embodiment of the present invention.

As shown in FIG. 16, the grinding tray 10 is of a long striplike structure and is capable of only eccentric rotation in a constant direction. The different positions of the grinding tray are provided with the grinding surfaces 9 of various grain densities, and a brushing surface 28 located between the two grinding surfaces, or an ultrasonic cleansing bath. A plurality of optical fibers are moved through the grinding surface 9, and the brushing surface 28 or ultrasonic cleansing bath, thereby resulting in the grinding, the cleansing, and the polishing of the optical fiber ends. Preferably, twelve optical fibers are held by a holder. Since each sanding paper can only be used to grind about ten times. This slows down the mass grinding operation. For this reason, we design the reel-type elastic grinding surfaces which are provided with various grinding surfaces of various grain densities and are located at one side of the rectangular grinding tray 10, and other reels serve to wind the worn-out grinding surface at the other side thereof, such that the grinding surface 9 can be rolled out across the grinding tray 10, as shown in FIG. 17. Depending on the wear condition, the other reel is driven by the motor to replace the grinding surface 9. In light of the grinding surface 9 of the present invention being capable of only the eccentric rotation, the motor, the reels, and the elastic surface and the grinding tray 10 are linked together.

As shown in FIGS. 16 and 17, the continuous grinding process of the optical fiber end involves the preliminary grinding, the precision grinding, the polishing, and the cleansing. In each process, the holder 3 is exerted on by different pressure and is therefore provided with an adjustable pressure device 8. The holder 3 may be movable or fixed. In the event that the holder 3 is fixed, the grinding tray 10 is movable.

The elastic grinding surface may be so changed that it is rigid to grind a planar mirror, a diamond mirror, or a planar optical fiber end. The wear of the grinding surface is uneven. At the outset, the grinding surface is planar. After a while, the grinding surface becomes recessed, thereby resulting in an increase in rejection rate in mass production. The remedial measure is to correct the grinding tray after a certain period of time or after a predetermined number of workpiece certain period of time or after a predetermined number of workpiece is processed, depending on the actual operational condition. The correction method involves the use of a heavy and rigid standard plane as a workpiece, which is placed on the grinding tray to proceed with the grinding. This correction process is done for a few times to planarize the grinding surface.

If the working areas of various grain densities are well partitioned, the conventional grinding material may be used in place of sand paper. The grinding material is a mixture of water and grinding powders different in graininess. It must be noted here that the grinding materials different in graininess must not be contaminated one another. The quality of the grinding will be seriously undermined by such contamination. The large granules are especially harmful to the optical fiber end which is being polished. We design the flow direction of the grinding fluid forward the preliminary grinding from the precision grinding. In addition, we deepen the trench for guiding the flow of the grinding fluid. In each cleansing process, the grinding material and the grinding chips are thoroughly removed from the optical fiber ends as well as the optical fiber holder.

Another task must be taken into consideration. This has to do with the removal of the grinding chips of the optical fiber ends. In the case of the conventional optical lens, if the grinding surface is asphalt, the failure to remove chips often results in difficulty for polishing the center of the optical lens. As a result, the grinding surface is often provided with trenches and a cavity located at the center of the grinding surface. The cavity and the trenches serve to store the chips which are removed from the workpiece, thereby enabling the grinding fluid to flow freely on the grinding surface without being obstructed by the chips.

Figure 18:
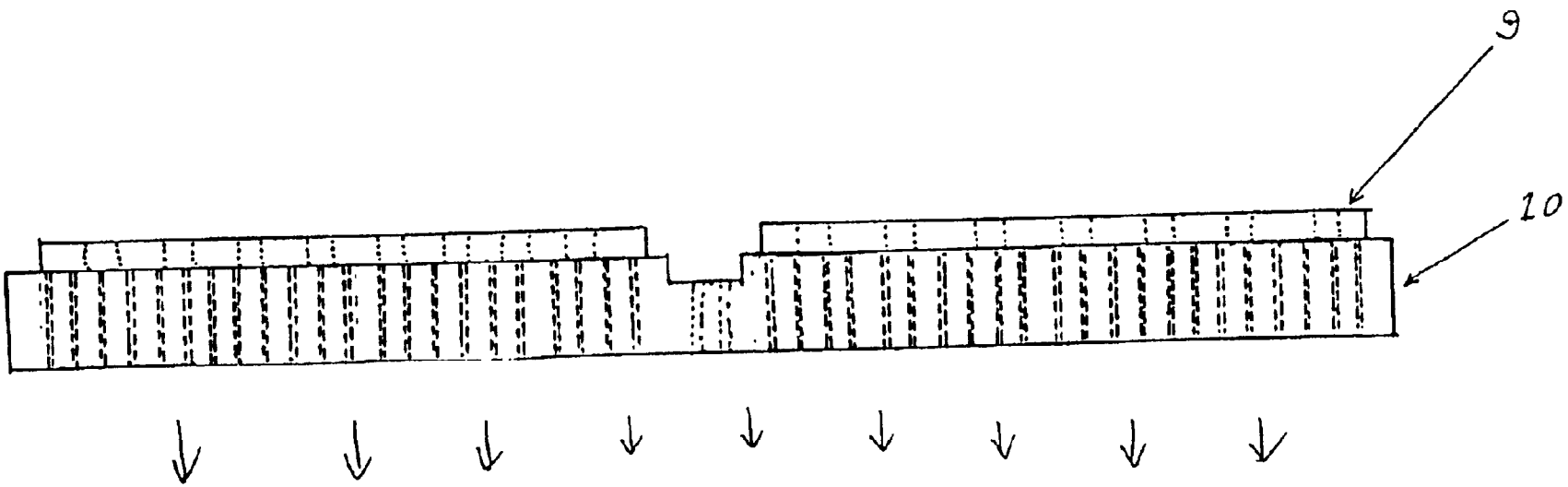
FIG. 18 shows a side schematic view of a grinding surface and a grinding tray which are suitable for use in the present invention, with the grinding surface being punched at the center thereof, with the grinding tray being provided at the midpoint thereof with a trench, and with the grinding surface and the grinding tray being provided uniformly with a plurality of through holes which are shown by dotted lines and are intended to drain the grinding fluid and to remove the grinding chips

In the grinding of the optical fiber ends, the optical fiber ends are held around an outer circumference of a holder. As a result, the removal of the grinding chips poses no problem at all. However, if the optical fiber ends are uniformly arranged in the holder, the removal of the grinding chips will be a problem. Under this circumstance, the grinding surface must be punched or provided with trenches. If the grinding tray is round, the optical fiber end holder must be round accordingly. The grinding tray 10 is provided at the center with a recess, as shown in FIG. 18. In addition, the grinding surface 9 is uniformly provided with larger holes as shown by the dotted lines. The grinding tray 10 is uniformly provided with smaller but denser holes, which are shown by the dotted lines. The grinding fluid is removed by suction under the grinding tray in the direction indicated by an arrow in FIG. 18.

Figure 19:
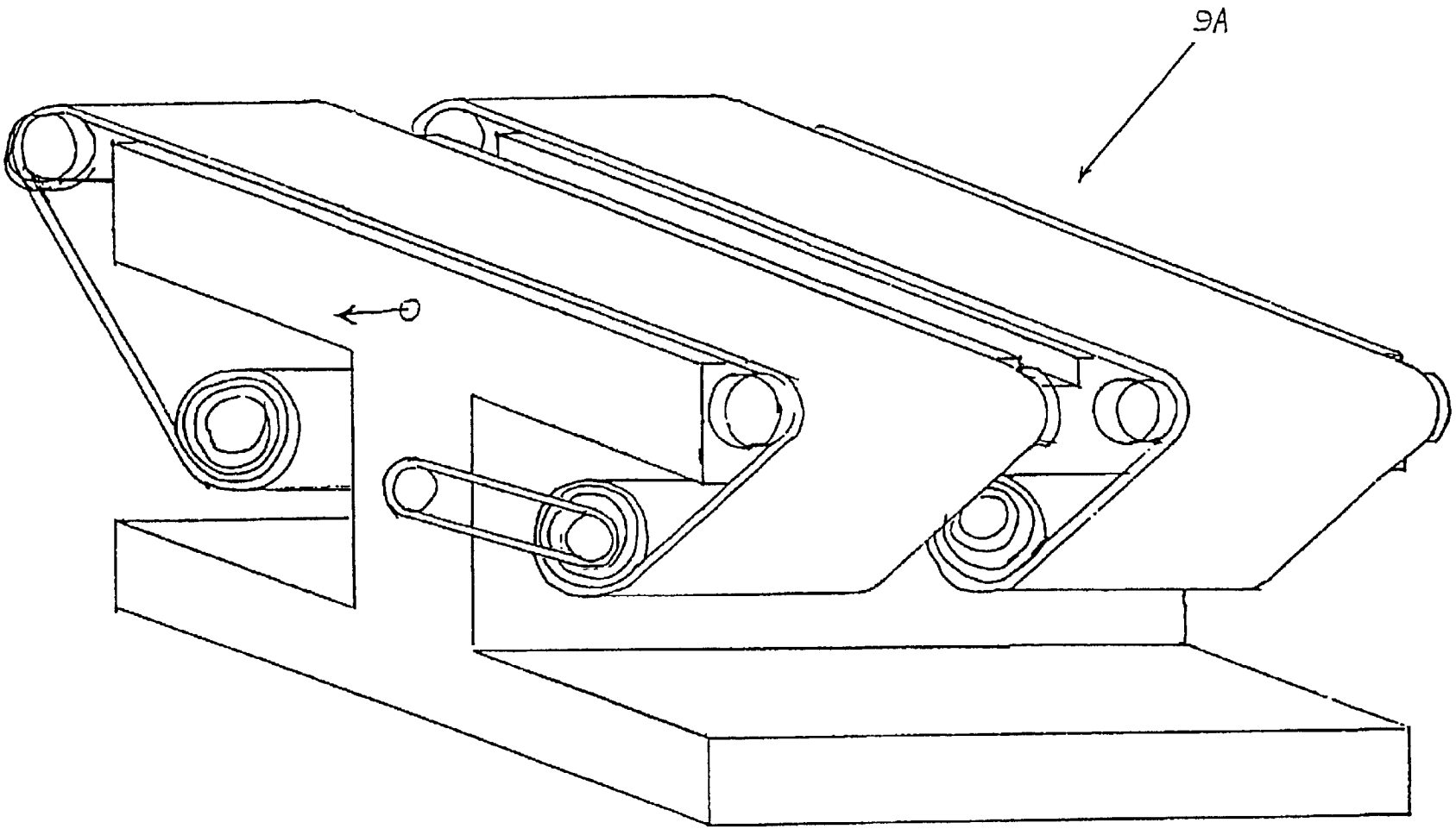
FIG. 19 shows a perspective view of a grinding unit suitable for use in the present invention.
Figure 20:
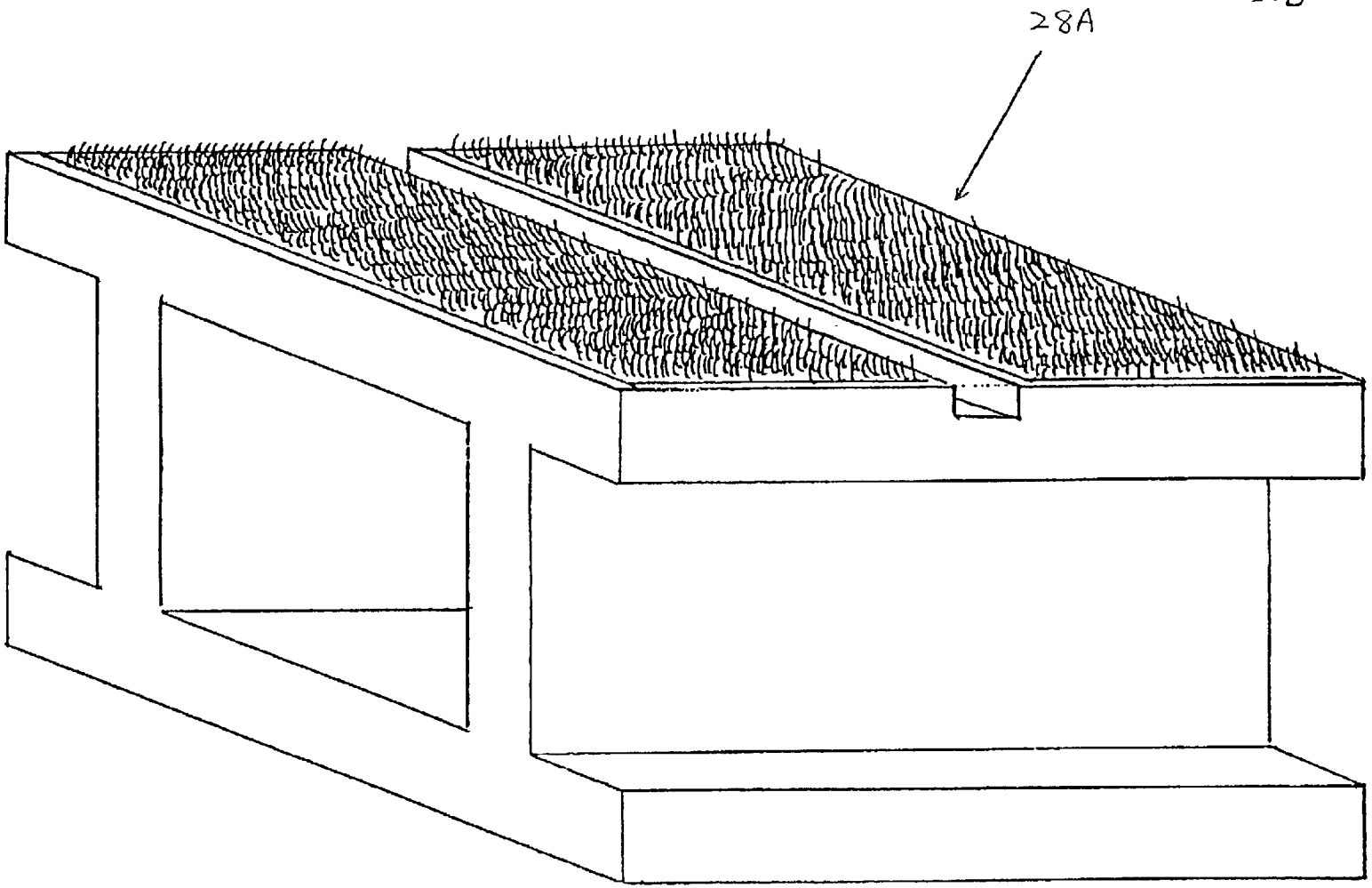
FIG. 20 shows a perspective view of a cleaning unit suitable for use in the present invention.
Figure 21:
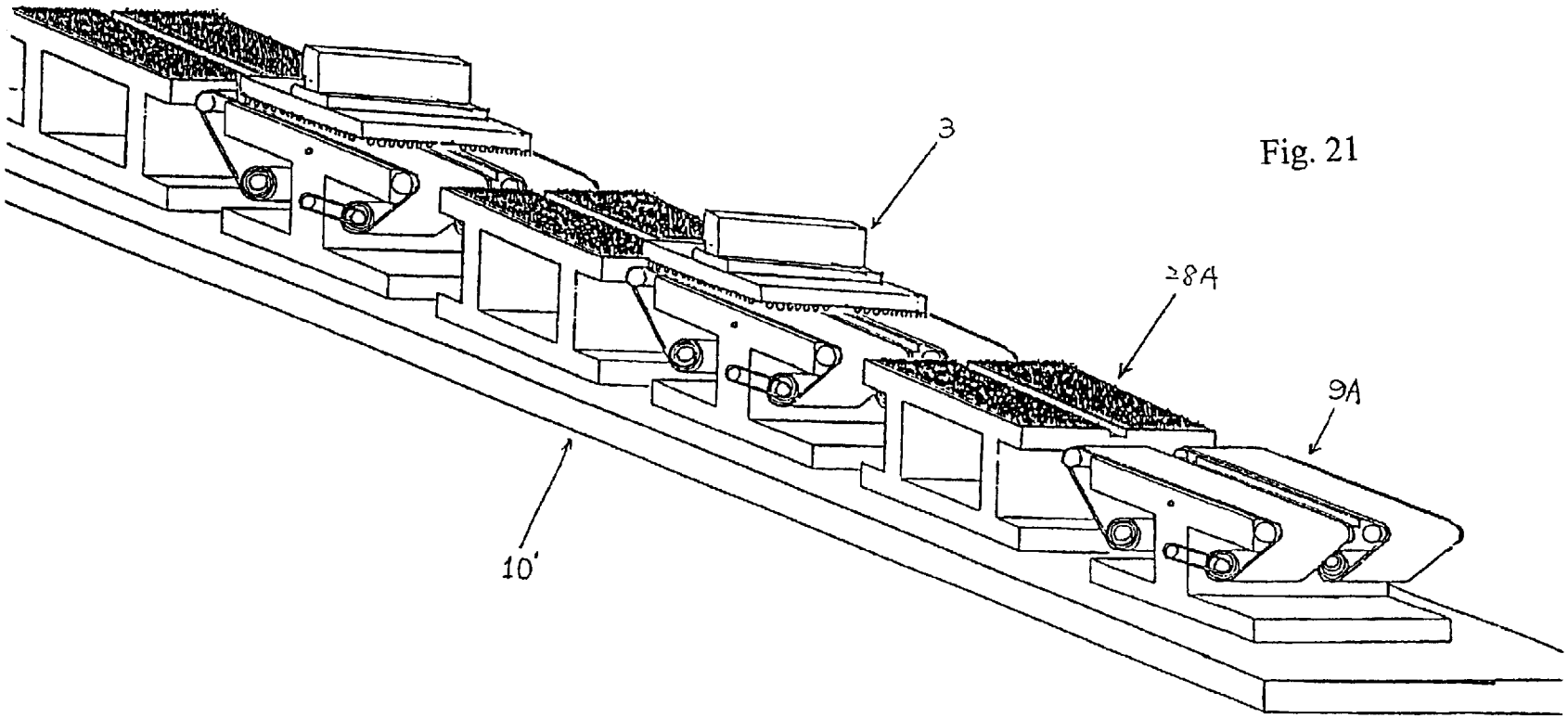
FIG. 21 shows a perspective view of a grinding equipment of a sixth preferred embodiment of the present invention.

The vacuum suction is intended to hold the grinding surface 9 and to remove the grinding fluid and the grinding chips. For this reason, the holes of the grinding tray 10 must be small enough to avoid adverse effect on the flatness of the grinding surface 9. The holes of the grinding tray 10 must be also large enough to prevent the clogging by the grinding powder and the workplace chips. The density of the holes of the grinding tray 10 must be appropriate such that any large hole of the grinding surface 9 must include the smaller hole of the grinding tray. In the meantime, the large hole of the grinding surface 9 must not be so large as to affect the grinding uniformity. The continuous grinding process, as shown in FIGS. 16 and 17, is more complicated in removing the grinding fluid and the grinding chips, wherein a middle trench is designed. The formation of the middle trench in the equipment shown in FIG. 16 is easier. The formation of the middle trench in the equipment shown in FIG. 17 is difficult. The present invention provides the following modular design in which a grinding unit 9A is first designed, as shown in FIG. 19, and in which a cleansing unit 28A is also designed, as shown in FIG. 20. Thereafter, a number of grinding units 9A and the cleansing units 28A are placed on a large planar surface 10' which undergoes eccentric rotation in a constant orientation, as shown in FIG. 21. There are only three grinding units and three cleansing units in FIG. 21. The number of the grinding unit and the cleansing unit depends on the operational requirement. The grinding unit 9A of FIG. 19 is provided with the middle trench, with the grinding surface and the grinding tray being punched in accordance with the method described with reference to FIG. 18. The removal of air, grinding fluid, and grinding chips is done by vacuum suction in the direction indicated by an arrow. As shown in FIG. 21, the optical fiber end holder 3 is rectangular. In view of the fact that each grinding unit 9A and each cleansing unit 28A are provided in the middle with a trench, the optical fiber ends must be held by the holder 3 in such a manner that the optical fiber ends should not obstruct the trenches.

The operation of the grinding of the optical fiber ends is done in a series of processes, such as preliminary grinding, cleansing, precision grinding, cleansing, polishing, and cleansing.

Figure 23:
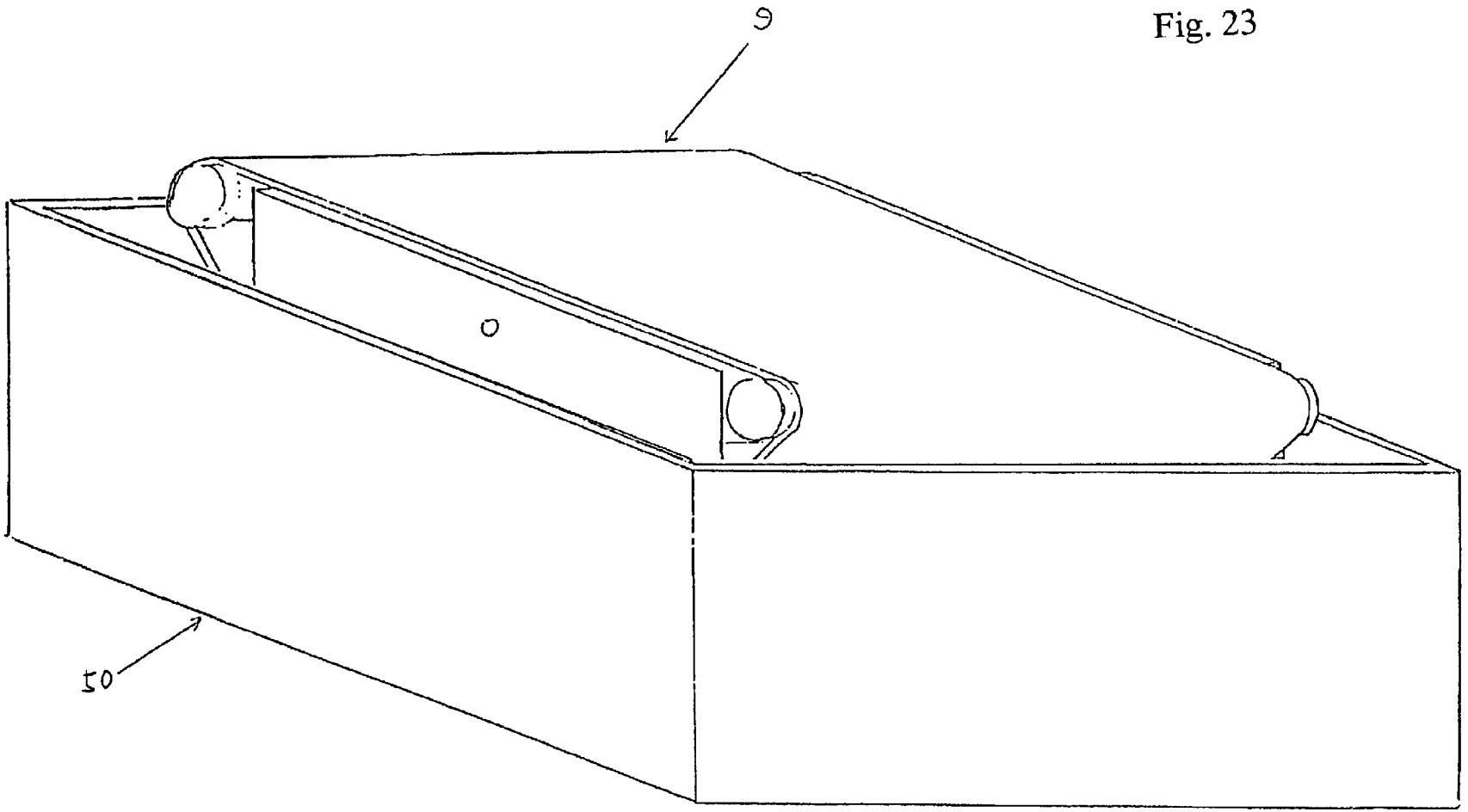
FIG. 23 shows a perspective view of a grinding unit suitable for use in the present invention, with the grinding unit being provided with a nondurable grinding surface which must be replaced often, and with the grinding unit being kept in a protective case.
Figure 24:
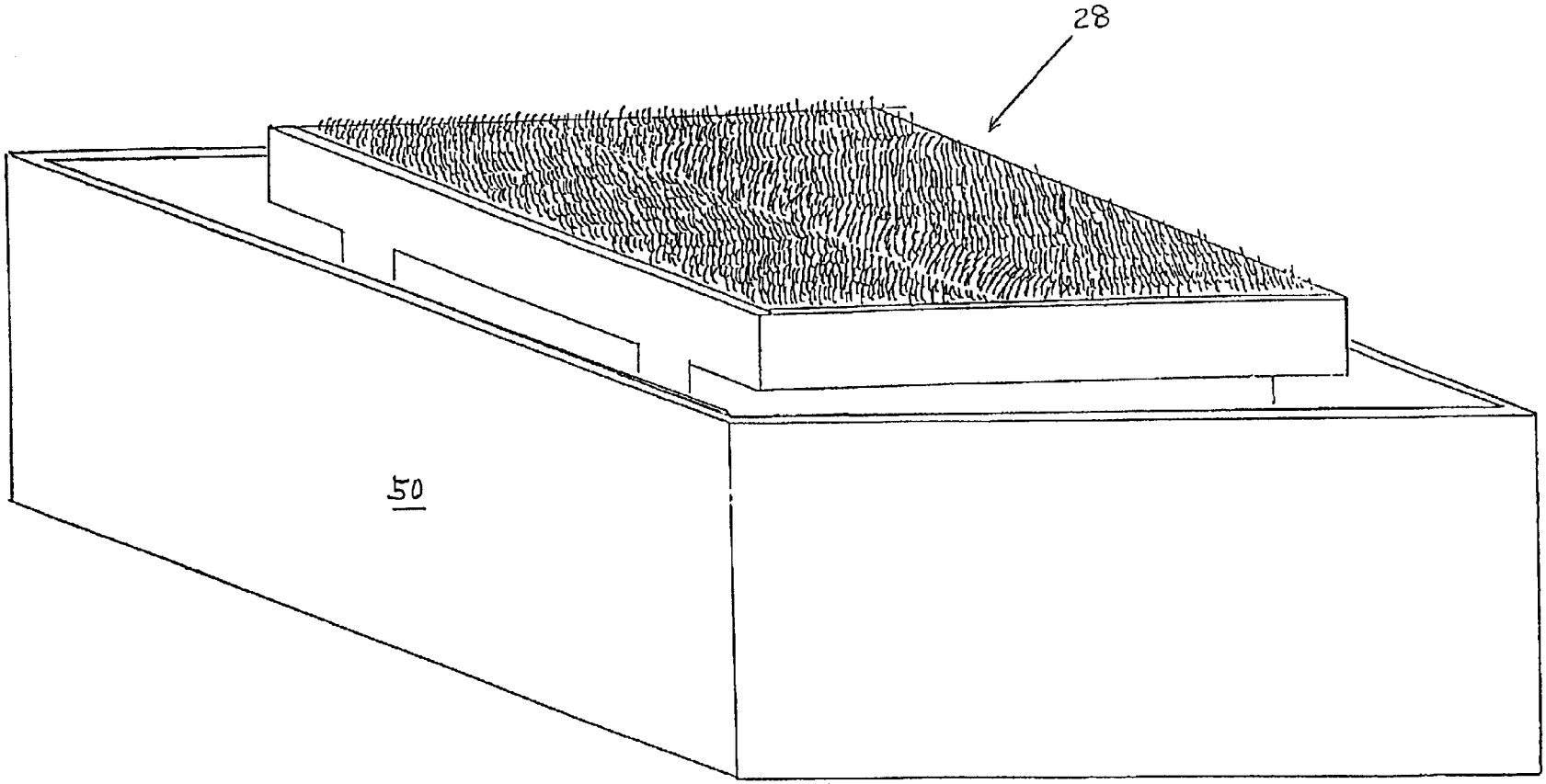
FIG. 24 shows a perspective view of a cleaning unit suitable for use in the present invention, with the cleaning unit being provided with a cleaning surface devoid of trenches and being kept in a case.

In the grinding process, caution must be exercised to prevent a grinding fluid of large granule from being mixed with a grinding fluid of small granule. In other words, these two grinding fluids must be carefully isolated. The present invention suggests that each grinding unit and each cleansing unit are kept in a case 50, as shown in FIGS. 22, 23, and 24.

Figure 22:
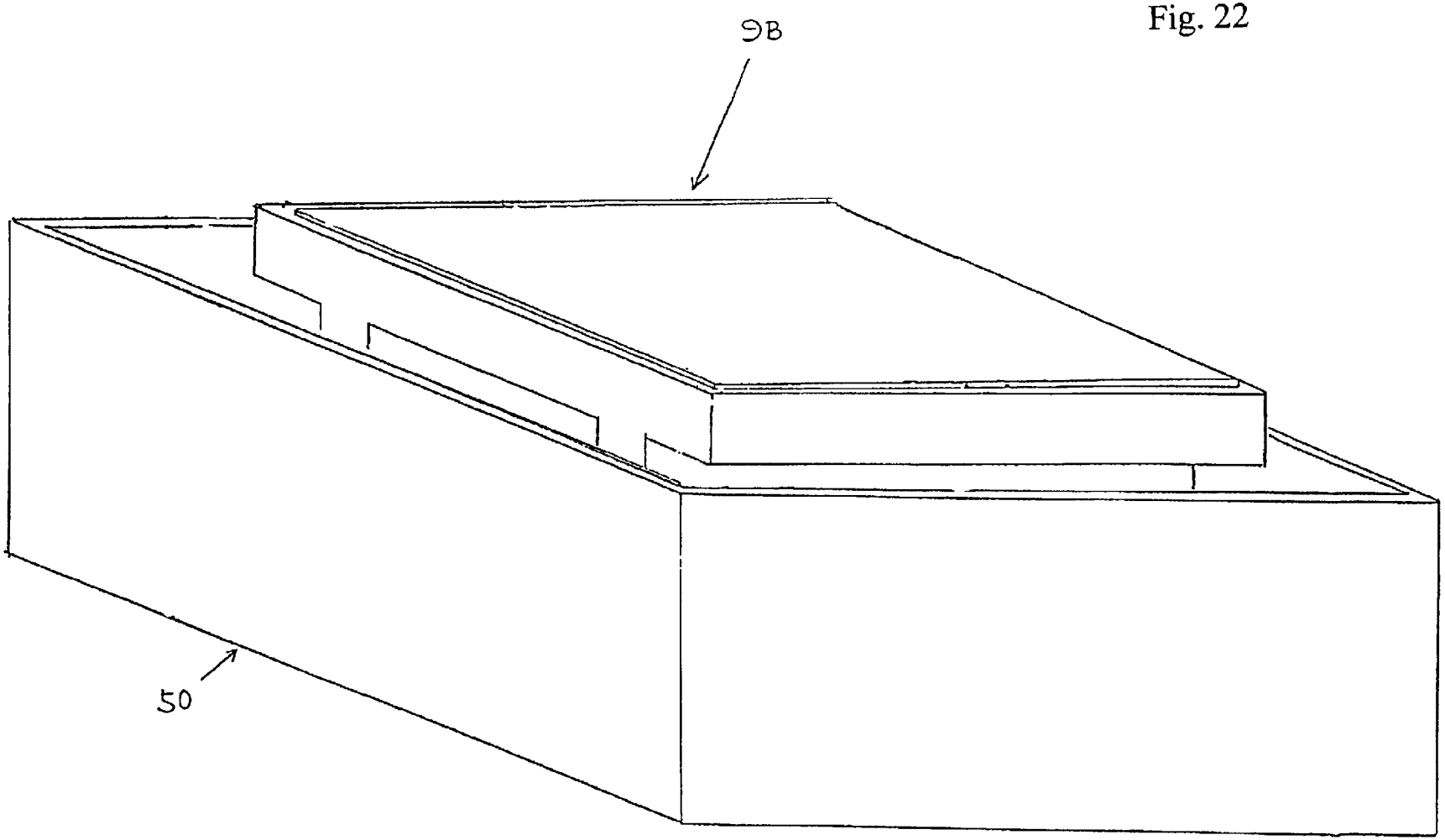
FIG. 22 shows a perspective view of a grinding unit suitable for use in the present invention, with the grinding unit being provided with a durable grinding surface which can be used without being replaced often, and with the grinding unit being kept in a protective case.
Figure 25:
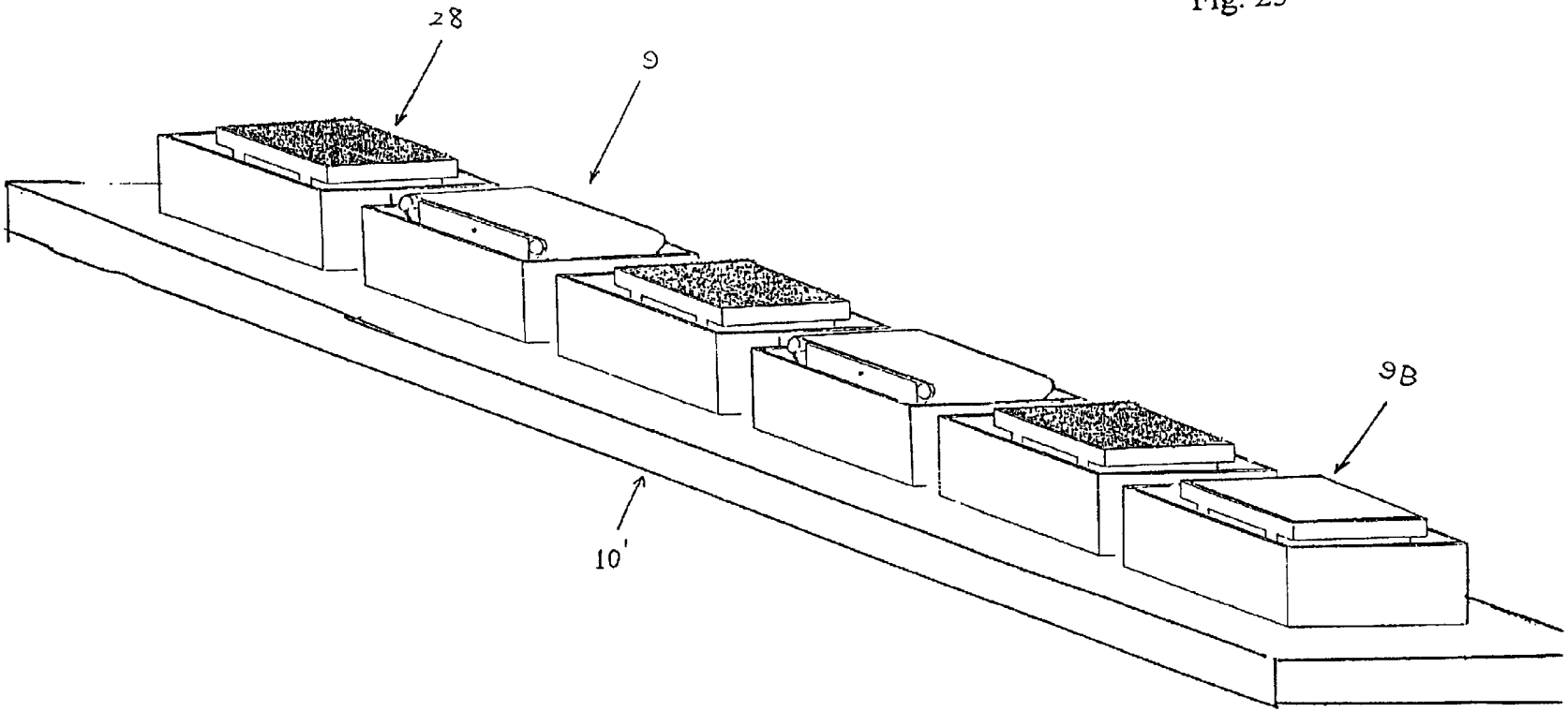
FIG. 25 shows a perspective view of a grinding equipment of a seventh preferred embodiment of the present invention.
Figure 26:
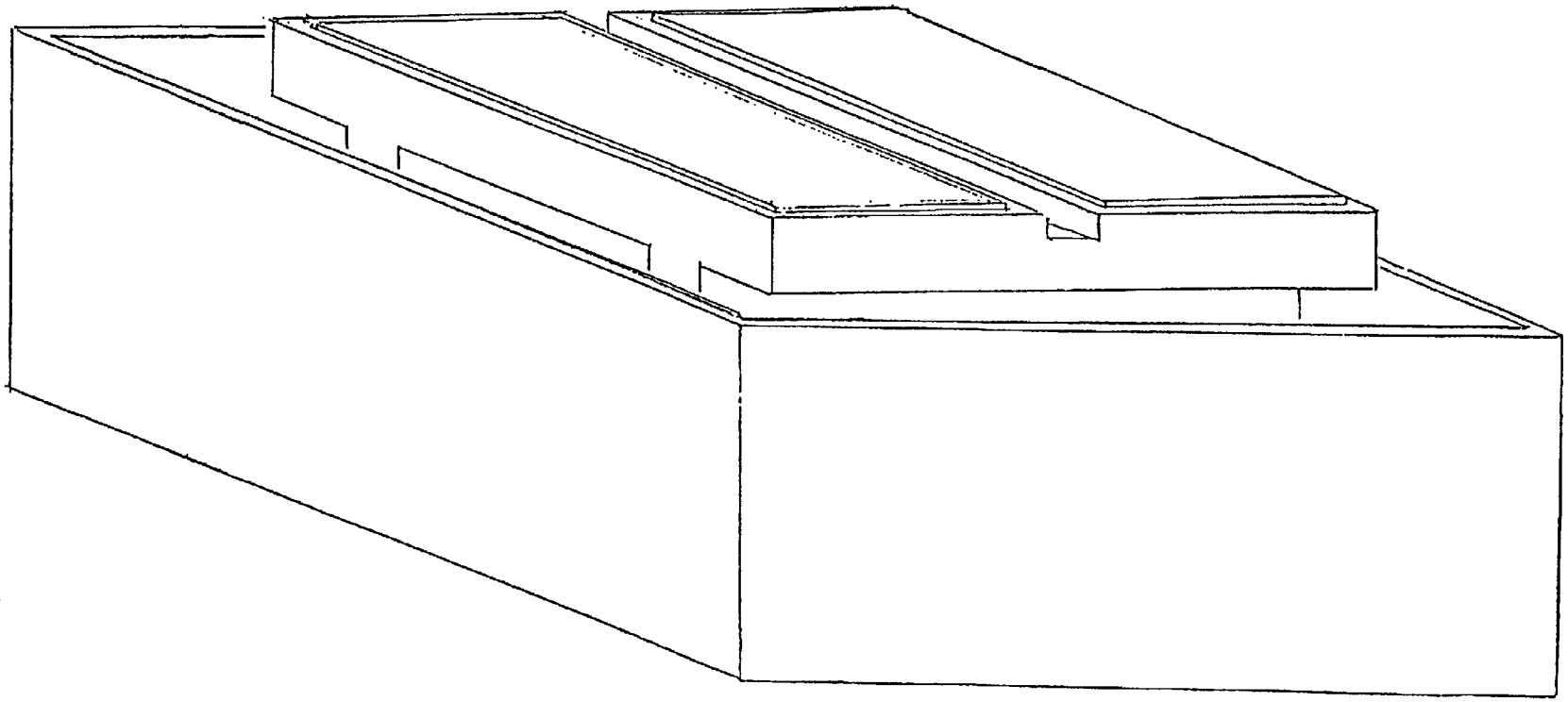
FIG. 26 shows a perspective view of a grinding unit suitable for use in the present invention, with the grinding unit being provided with a durable grinding surface which is provided with a center slot and is used without being replaced often, and with the grinding unit being kept in a case.
Figure 27:
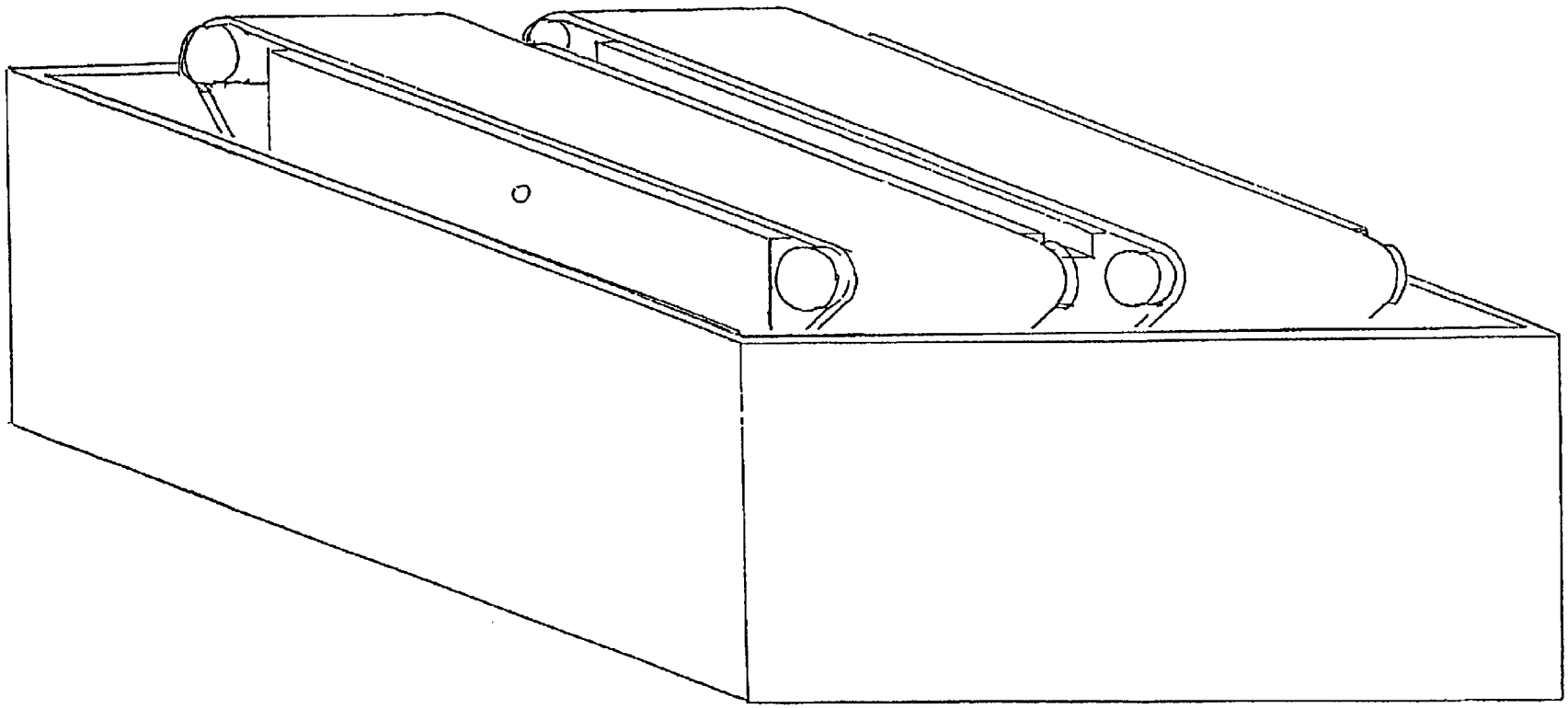
FIG. 27 shows a perspective view of a grinding unit suitable for use in the present invention, with the grinding unit being provided with a nondurable grinding surface which is provided with a center slot and is often replaced, and with the grinding unit being kept in case.
Figure 28:
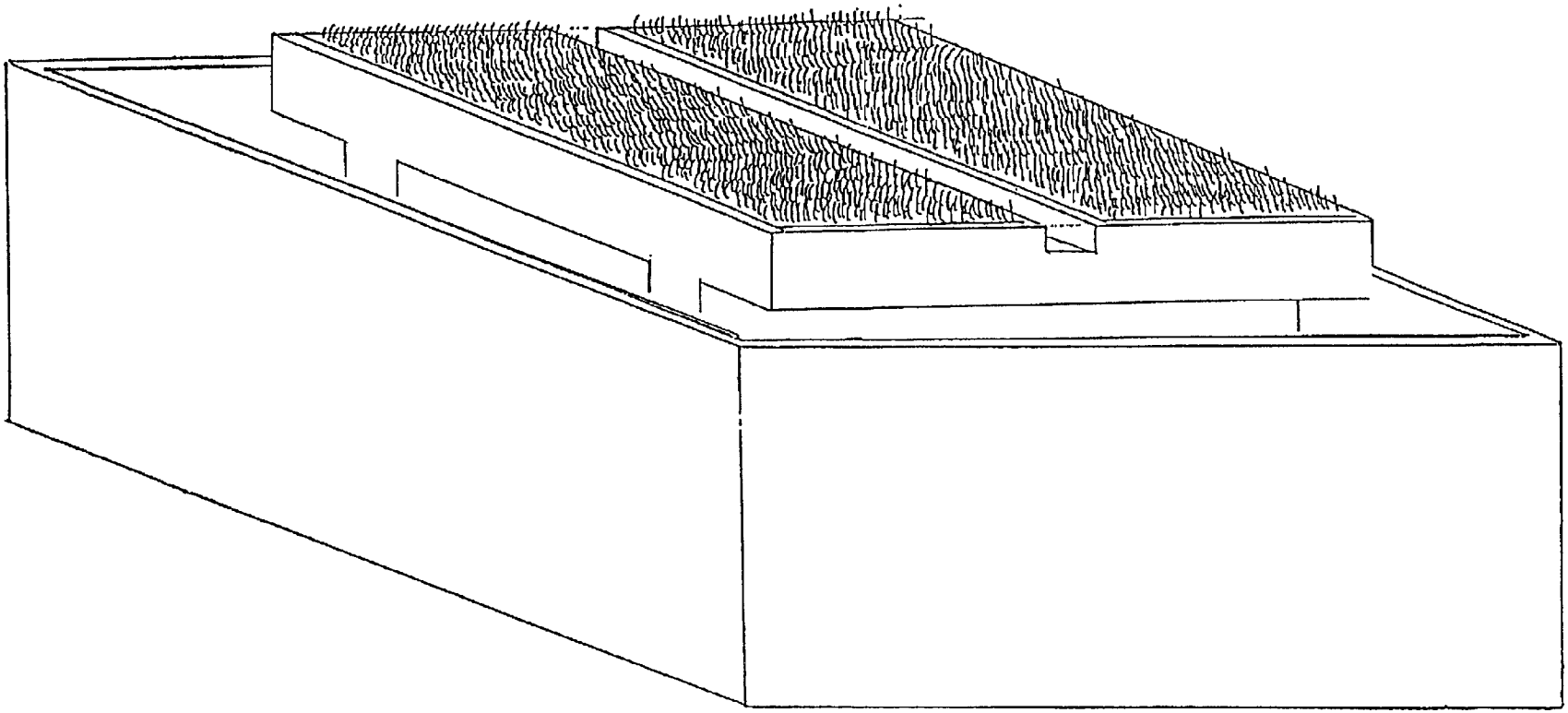
FIG. 28 shows a perspective view of a cleaning unit suitable for use in the present invention, with the cleaning unit being provided with a centrally-slotted cleaning surface and being kept in a case.
Figure 29:
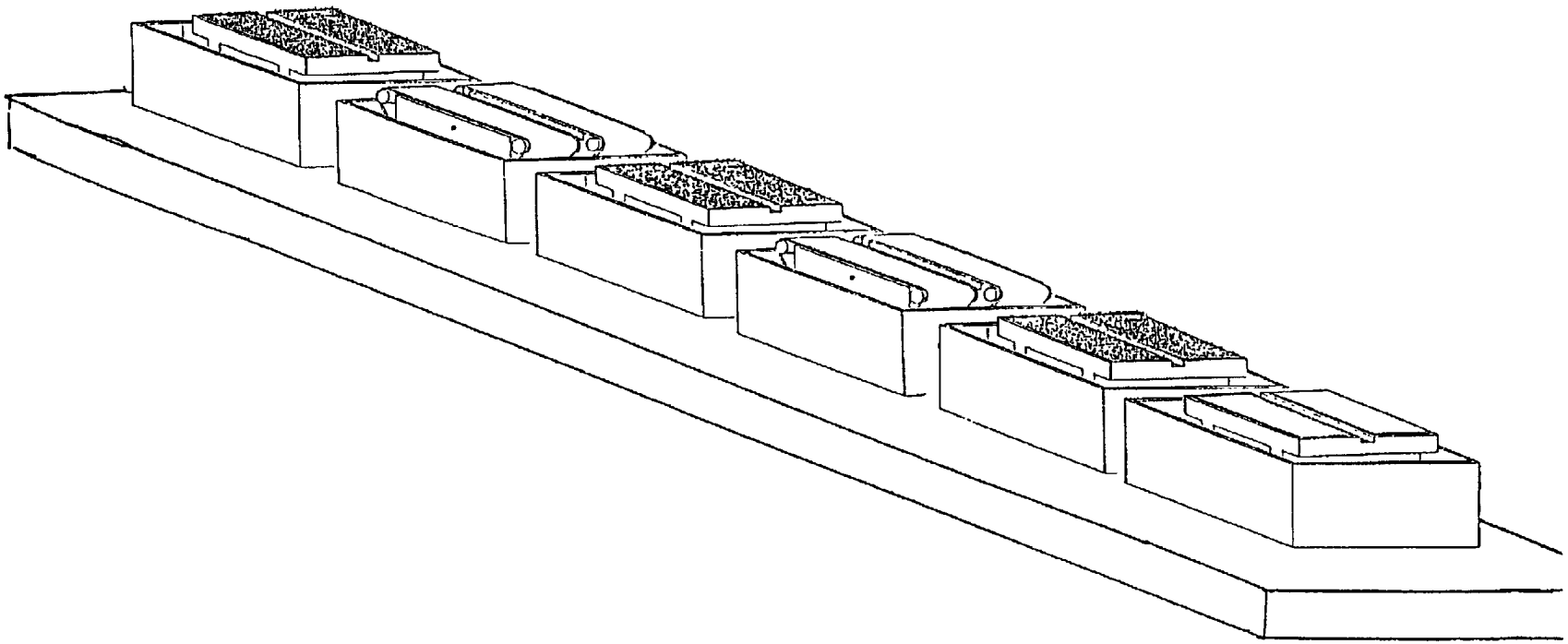
FIG. 29 shows a perspective view of a grinding equipment of an eighth preferred embodiment of the present invention.

As shown in FIG. 22, a durable grinding surface 9B is free of the middle trench and is not replaced frequently. As shown in FIG. 23, a nondurable grinding surface 9 is free of the middle trench and is replaced often. As shown in FIG. 24, a cleansing surface 28 is free of the middle trench. Similar to the way illustrated in FIG. 21, they are placed on a large planar surface 10' which undergoes a eccentric rotation in a constant orientation and, thereby making them ready for grinding operation, as shown in FIG. 25.

As shown in FIGS. 26, 27, 28, and 29, the designs are basically similar to those which are described above with reference to FIGS. 22-25, with the difference being that the former are provided with a middle trench on the grinding surface and the cleaning surface of each grinding unit and cleansing unit.

As shown in FIGS. 25-29, the continuous grinding equipments of the present invention are provided with the grinding unit in which the used grinding fluid is collected, discharged, or recycled. In addition, they are provided with the cleansing unit in which the used water is collected and discharged.

What is claimed is:

1. A device for providing a plurality of workpiece ends with a convex surface, said equipment comprising:

a holder for holding workpiece ends such that the workpiece ends are substantially and equally raised above a planar surface of said holder;

a first elastic grinding surface for grinding and polishing the workpiece ends held by said holder;

a driving device for driving said holder or said elastic grinding surface to engage in an eccentric rotation in a constant orientation;

a pressure device for providing a predetermined pressure under which the workpiece ends are kept in contact with said elastic grinding surface, thereby enabling the workpiece ends to be ground or polished by said elastic grinding surface; and one or more additional elastic grinding surfaces in addition to said first elastic grinding surface whereby said elastic grinding surfaces are used to grind or polish the workpiece ends in conformity with various specifications, with said elastic grinding surfaces being driven by said driving device to engage in an eccentric rotation in a constant orientation such that said additional elastic grinding surfaces come in contact with the workpiece ends one after another under the same or different pressure provided by said pressure device.

2. The device as claimed in claim 1 further comprising one or more cleansing devices for cleansing the workpiece ends at the time when the workpiece ends are disengaged with said additional elastic grinding surfaces.

3. The device as claimed in claim 2, wherein said cleansing devices are selected from the group consisting of brushing surfaces, ultrasonic cleansing devices, and a combination of said brushing surfaces and said ultrasonic cleansing.

4. The device as claimed in claim 2, wherein said cleansing devices are elastic brushing surfaces, whereby said elastic brushing surfaces and said elastic grinding surfaces form a tape-shaped element such that said elastic brushing surfaces and said elastic grinding surfaces are serially arranged at intervals.

5. The device as claimed in claim 1, wherein said holder and said elastic grinding surface are driven by said driving device to engage in the eccentric rotation at different speeds and in the constant orientation.

6. The device as claimed in claim 1, wherein said first elastic grinding surface is driven to engage in a linear reciprocating motion.

7. The device as claimed in claim 1, wherein said holder is driven to engage in a linear reciprocating motion.

8. The device as claimed in claim 1, wherein said holder and said first elastic grinding surface are driven to engage in a linear reciprocating motion in different directions.

9. The device as claimed in claim 1, wherein first said elastic grinding surface is provided with a plurality of holes, wherein said holes are uniformly arranged and have a hole diameter ranging between 0.1 mm and 4.0 mm.

10. The device as claimed in claim 1, wherein said elastic grinding surface and said grinding tray are provided at a center thereof with a center hole with a diameter ranging between 0.1 mm and 4.0 cm, and wherein said center hole of said grinding tray does not penetrate through said grinding tray.

11. The device as claimed in claim 1 further comprising a vacuum suction system corresponding in location to said grinding tray, wherein said grinding tray is provided with a plurality of holes ranging in diameter from 0.1 mm to 4.0 mm, and said vacuum suction system is for removing grinding chips and grinding fluid, and for holding said first elastic grinding surface by providing suction to said plurality of holes of said grinding tray.

12. The device as claimed in claim 1 further comprising a plurality of add-on elastic grinding surfaces, and a plurality of add-on holders identical to said holder, with some of said add-on holders or all of said add-on elastic grinding surfaces being driven by said driving device to engage in the eccentric rotation in the constant orientation such that a plurality of workpiece ends held by some of said add-on holders are kept in contact at the same time with said add-on elastic grinding surfaces under a predetermined pressure provided by said pressure device, thereby enabling the workpiece ends to be ground or polished in various degrees.

13. The device as claimed in claim 12, wherein said add-on elastic grinding surfaces comprise an elastic tape on which a grinding material or a polishing material is disposed, wherein said elastic tape is wound at both ends on two reels.

14. The device as claimed in claim 12 further comprising a plurality of cleansing devices for cleansing the workpiece ends, said cleansing devices being arranged at intervals along with said add-on elastic grinding surfaces thereby enabling the workpiece ends held by other portion of said add-on holders to be cleansed at the same time by said cleansing devices during the time that the workpiece ends held by said some of said add-on holders are being ground or polished.

15. The device as claimed in claim 14, wherein said cleansing devices are brushing surfaces, ultrasonic cleansing devices, or a combination of said brushing surfaces and said ultrasonic cleansing devices.

16. The device as claimed in claim 14 further comprising a conveyer for transporting all of said holders such that said holders move past one after another all of said elastic grinding surfaces and all of said cleansing devices.

17. The device as claimed in claim 14 further comprising a conveyer for transporting intermittently all of said elastic grinding surfaces and all of said cleansing devices such that all of said elastic grinding surfaces and all of said cleansing devices move past one after another all of said holders.

18. The device as claimed in claim 12 further comprising a grinding tray on which all of said add-on elastic grinding surfaces are disposed whereby said grinding tray and said add-on elastic grinding surfaces are driven by said driving device to engage synchronously in the eccentric rotation in the constant orientation.

19. The device as claimed in claim 12, wherein said driving device drives portion of said holders and all of said add-on elastic grinding surfaces to engage in the eccentric rotation at various speeds and in the constant orientation.

20. The device as claimed in claim 14 further comprising a grinding tray on which all of said add-on elastic grinding surfaces and all of said cleansing devices are disposed, wherein said grinding tray is driven by said driving device to engage in the eccentric rotation in the constant orientation.

21. The device as claimed in claim 18, wherein all of said add-on elastic grinding surfaces are provided with a plurality of holes ranging in diameter between 0.1 mm and 4.0 mm.

22. The device as claimed in claim 18, wherein all of add-on said elastic grinding surfaces and said grinding tray are provided at a center thereof with a center trench ranging in width from 1 mm to 4 cm, wherein said center trench of said grinding tray does not penetrate through said grinding tray.

23. The device as claimed in claim 21, wherein all of said add-on elastic grinding surfaces and said grinding tray are provided at a center thereof with a center trench ranging in width from 1 mm to 4 cm, wherein said center trench of said grinding tray does not penetrate through said grinding tray.

24. The device as claimed in claim 21 further comprising a vacuum suction system corresponding in location to said grinding tray, wherein said grinding tray is provided with; a plurality of holes ranging in diameter from 0.1 mm to 4.0 mm, and said vacuum suction system is for removing grinding chips and grinding fluid, and for holding said first elastic grinding surface by providing suction to said plurality of holes of said grinding tray.

25. The device as claimed in claim 22 further comprising a vacuum suction system corresponding in location to said grinding tray, wherein said grinding tray is provided with a plurality of holes ranging in diameter from 0.1 mm to 4.0 mm, and said vacuum suction system is for removing grinding chips and grinding fluid, and for holding said first elastic grinding surface by providing suction to said plurality of holes of said grinding tray.

26. The device as claimed in claim 18 further comprising a plurality of containers, wherein said containers are disposed on said grinding tray such that all of said elastic grinding surfaces are held in said containers, with said containers serving to collect grinding chips and grinding fluids.

27. The device as claimed in claim 20 further comprising a plurality of containers, wherein said containers are disposed on said grinding tray such that all of said elastic grinding surfaces and all of said cleansing devices are held in said containers, with said containers serving to collect grinding chips, grinding fluids, and cleansing wastes.

28. The device as claimed in claim 21 further comprising a plurality of containers, wherein said containers are disposed on said grinding tray such that all of said elastic grinding surfaces are held in said containers, with said containers serving to collect grinding chips and grinding fluids.

29. The device as claimed in claim 22 further comprising a plurality of containers, wherein said containers are disposed on said grinding tray such that all of said elastic grinding surfaces are held in said containers, with said containers serving to collect grinding chips and grinding fluids.

30. The device as claimed in claim 24 further comprising a plurality of containers, wherein said containers are disposed on said grinding tray such that all of said add-on elastic grinding surfaces are held in said containers, with said containers serving to collect grinding chips and grinding fluids.

31. The device as claimed in claim 25 further comprising a plurality of containers, wherein said containers are disposed on said grinding tray such that all of said add-on elastic grinding surfaces are held in said containers, with said containers serving to collect grinding chips and grinding fluids.

32. A device for providing a plurality of workpiece ends with a convex surface, said equipment comprising:

a holder for holding workpiece ends such that the workpiece ends are substantially and equally raised above a planar surface of said holder;

a first elastic grinding surface for grinding and polishing the workpiece ends held by said holder;

a driving device for driving said holder or said elastic grinding surface to engage in an eccentric rotation in a constant orientation;

a pressure device for providing a predetermined pressure under which the workpiece ends are kept in contact with said elastic grinding surface, thereby enabling the workpiece ends to be ground or polished by said elastic grinding surface;

one or more additional elastic grinding surfaces in addition to said first elastic grinding surface whereby said elastic grinding surfaces are used to grind or polish the workpiece ends in conformity with various specifications, with said elastic grinding surfaces being driven by said driving device to engage in an eccentric rotation in a constant orientation such that said additional elastic grinding surfaces come in contact with the workpiece ends one after another under the same or different pressure provided by said pressure device; and wherein said first elastic grinding surface is driven to engage in a linear reciprocating motion.

33. A device for providing a plurality of workpiece ends with a convex surface, said equipment comprising:

a holder for holding workpiece ends such that the workpiece ends are substantially and equally raised above a planar surface of said holder;

a first elastic grinding surface for grinding and polishing the workpiece ends held by said holder;

a driving device for driving said holder or said elastic grinding surface to engage in an eccentric rotation in a constant orientation;

a pressure device for providing a predetermined pressure under which the workpiece ends are kept in contact with said elastic grinding surface, thereby enabling the workpiece ends to be ground or polished by said elastic grinding surface;

one or more additional elastic grinding surfaces in addition to said first elastic grinding surface whereby said elastic grinding surfaces are used to grind or polish the workpiece ends in conformity with various specifications, with said elastic grinding surfaces being driven by said driving device to engage in an eccentric rotation in a constant orientation such that said additional elastic grinding surfaces come in contact with the workpiece ends one after another under the same or different pressure provided by said pressure device; and wherein said holder is driven to engage in a linear reciprocating motion.

* * * * *